US009277325B2

(12) United States Patent
Zhang

(10) Patent No.: US 9,277,325 B2
(45) Date of Patent: Mar. 1, 2016

(54) INNER MAGNETIC TRANSDUCER WITH MULTIPLE MAGNETIC GAPS AND MULTIPLE COILS AND PREPARATION METHOD THEREOF

(76) Inventor: Fan Zhang, Chengdu (CN)

( * ) Notice: Subject to any disclaimer, the term of this patent is extended or adjusted under 35 U.S.C. 154(b) by 1022 days.

(21) Appl. No.: 13/265,876

(22) PCT Filed: Feb. 23, 2009

(86) PCT No.: PCT/CN2009/070507

§ 371 (c)(1),
(2), (4) Date: Jan. 18, 2012

(87) PCT Pub. No.: WO2009/103247

PCT Pub. Date: Aug. 27, 2009

(65) Prior Publication Data

US 2012/0163651 A1 Jun. 28, 2012

(30) Foreign Application Priority Data

Feb. 21, 2008 (CN) ..... 2008 1 0065384
Oct. 10, 2008 (CN) ..... 2008 2 0212277

(51) Int. Cl.

| | |
|---|---|
| ***H04R 1/00*** | (2006.01) |
| ***H04R 9/02*** | (2006.01) |
| ***H04R 9/04*** | (2006.01) |
| ***H04R 9/06*** | (2006.01) |
| *H04R 31/00* | (2006.01) |

(52) U.S. Cl.

CPC ..... *H04R 9/025* (2013.01); *H04R 9/046* (2013.01); *H04R 9/063* (2013.01)

(58) Field of Classification Search

USPC ..... 381/400–412; 29/594
See application file for complete search history.

(56) References Cited

FOREIGN PATENT DOCUMENTS

| | | | |
|---|---|---|---|
| CN | 1219834 A | * | 6/1999 |
| CN | 1121809 C | * | 9/2003 |
| CN | 1741683 A | * | 3/2006 |

OTHER PUBLICATIONS

PCT, International Preliminary Report on Patentability for PCT/CN2009/070507, Jun. 4, 2009.
Translation of International Preliminary Report on Patentability for PCT/CN2009/070507, Jun. 4, 2009.

* cited by examiner

*Primary Examiner* — Sunita Joshi

(57) ABSTRACT

An inner magnetic transducer with multiple magnetic gaps and multiple coils, and a preparation method thereof. The inner magnetic transducer with multiple magnetic gaps and multiple coils includes a non-magnetic material frame and a non-magnetic material bearer frame. The inner magnetic transducer with multiple magnetic gaps and multiple coils includes two or more coaxial annular magnetic gaps with the same diameter value, two suits of symmetric magnetic paths, and a symmetric coil. In the transducer, enwinding direction, connection mode and parameters of coils are decided, in order to ensure that the value of the inductance of coils and the opposing electromotive force obtained during the process of moving to and fro are counteracted by each other. The inner magnetic transducer with multiple magnetic gaps and multiple coils has resistance load character or approximately has a resistance load character, simultaneously, has high sensitivity, high analytic capability, and high fidelity.

9 Claims, 15 Drawing Sheets

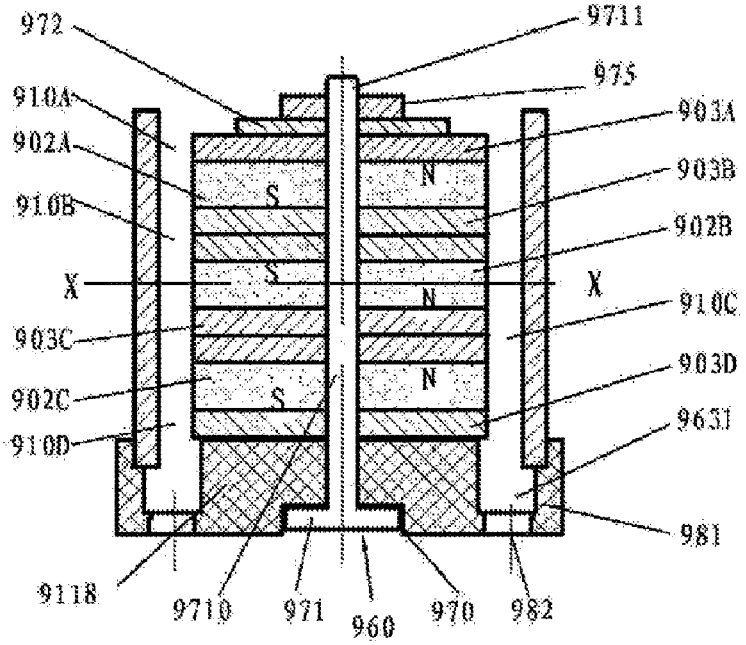
FIG. 9
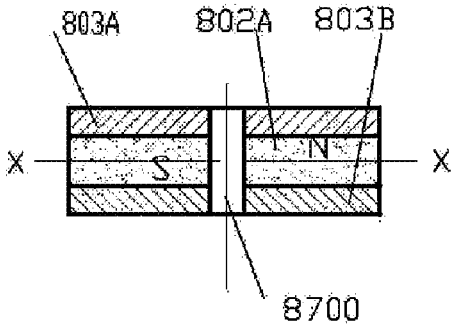
FIG. 10-A
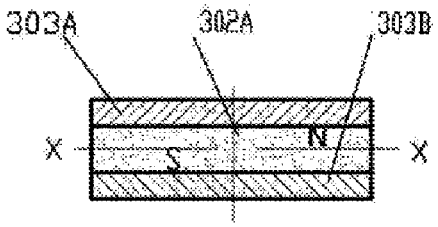
FIG. 10-B

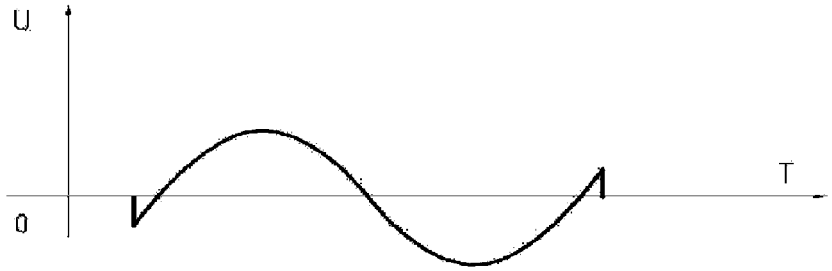
FIG. 14-A
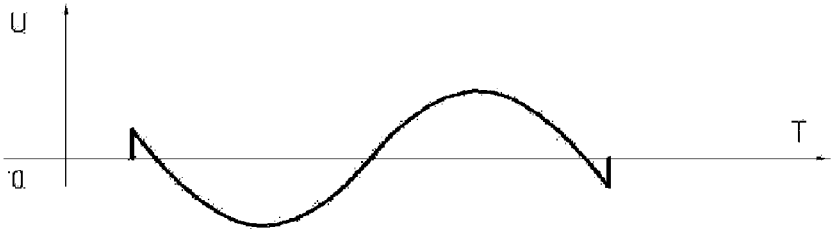
FIG. 14-B
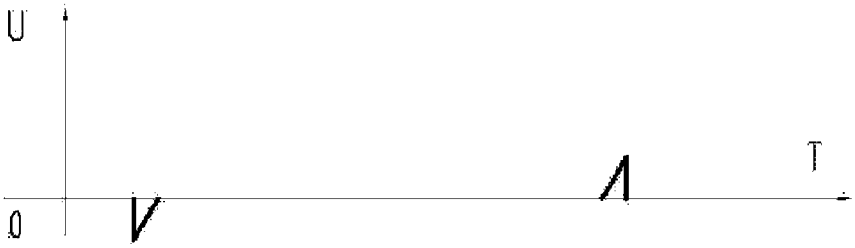
FIG. 14-C
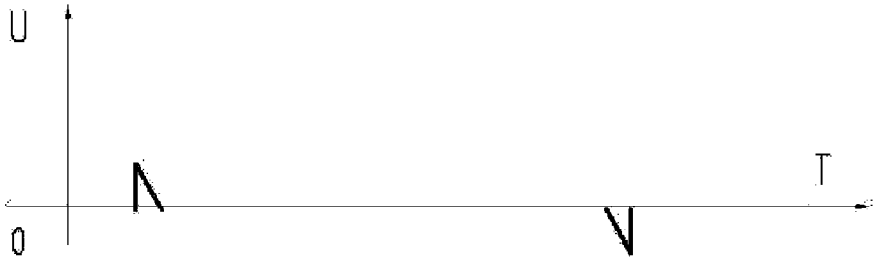
FIG. 14-D

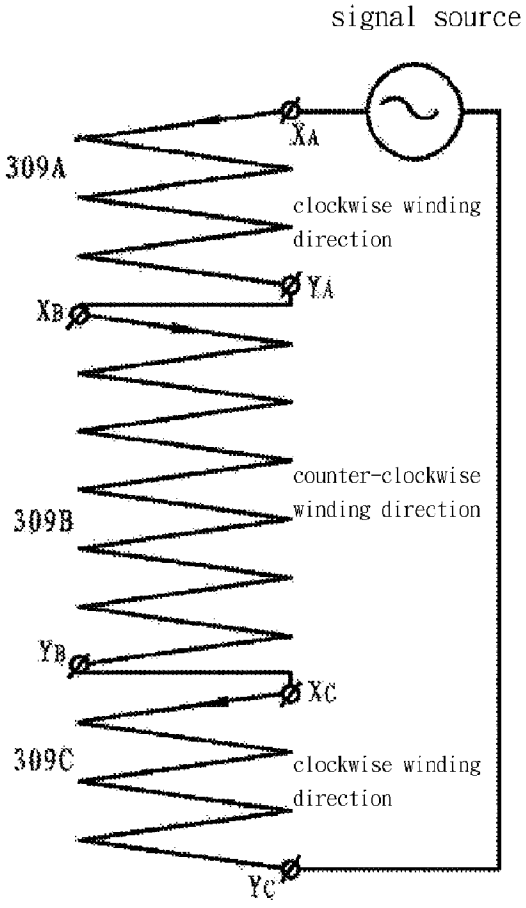
FIG. 16-B
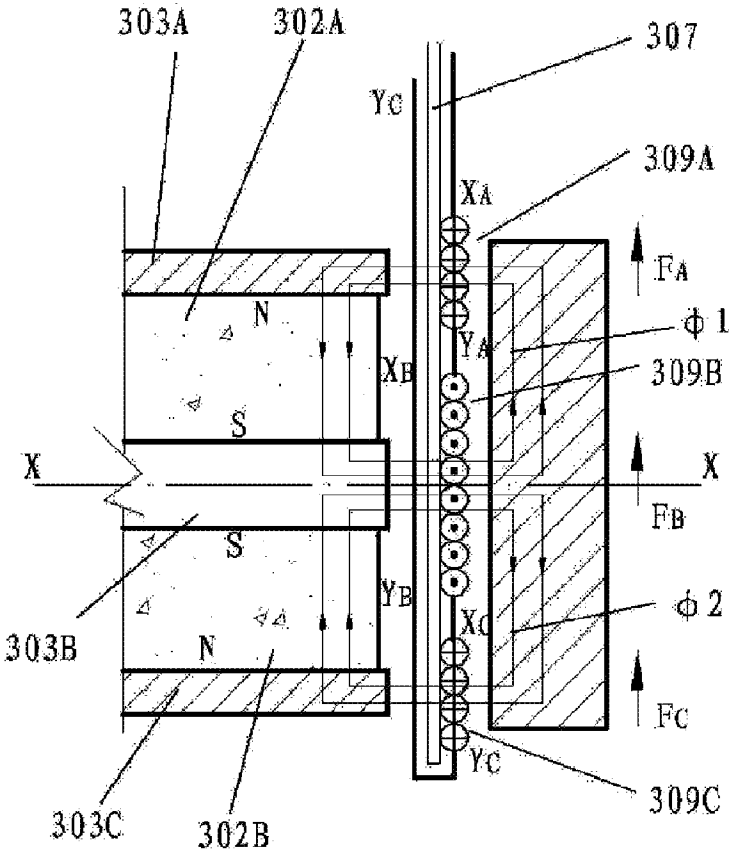
FIG. 16-A

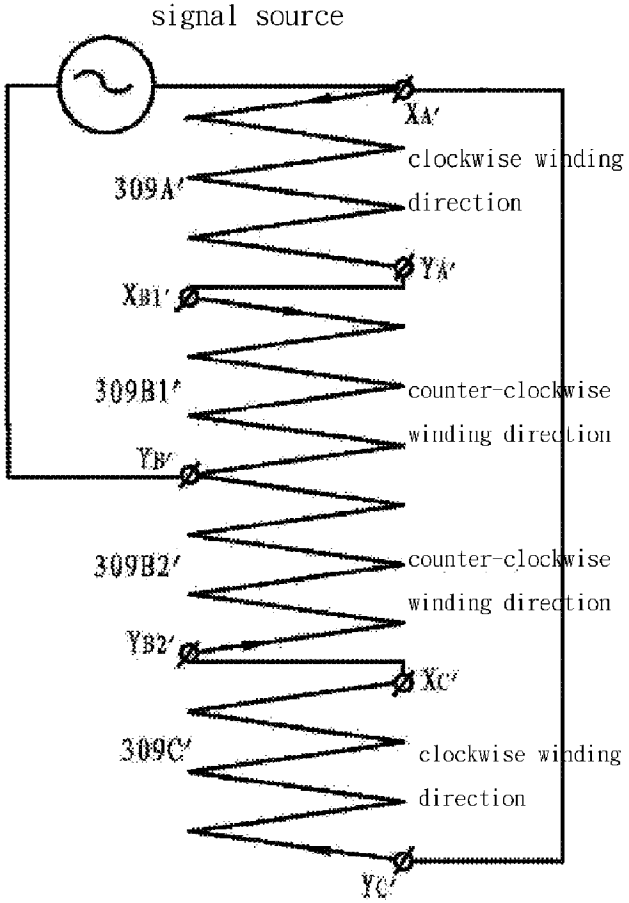
FIG. 17-B
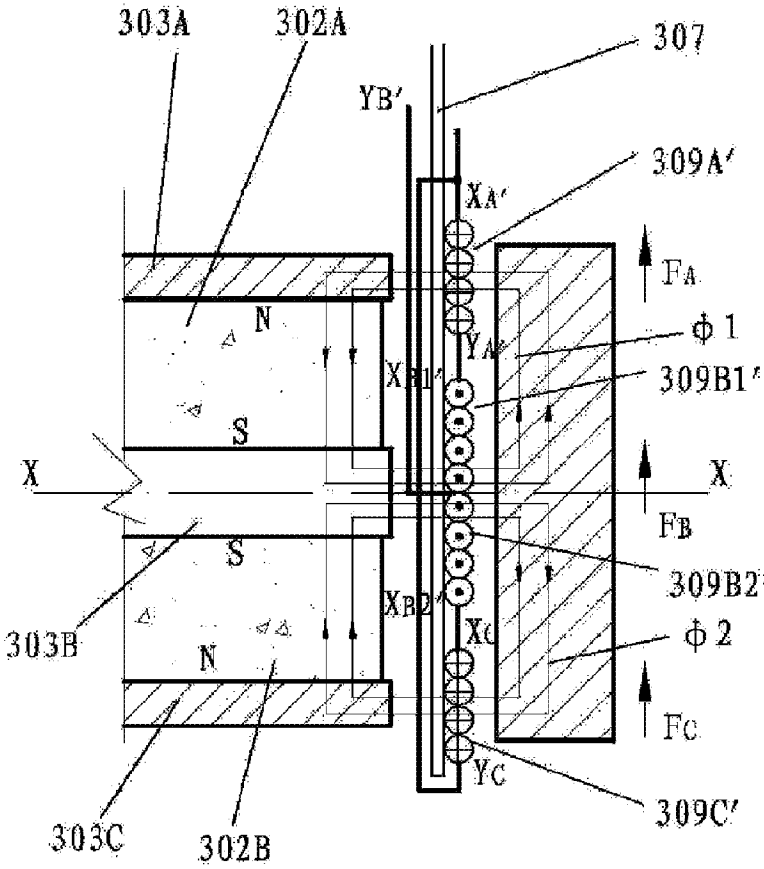
FIG. 17-A

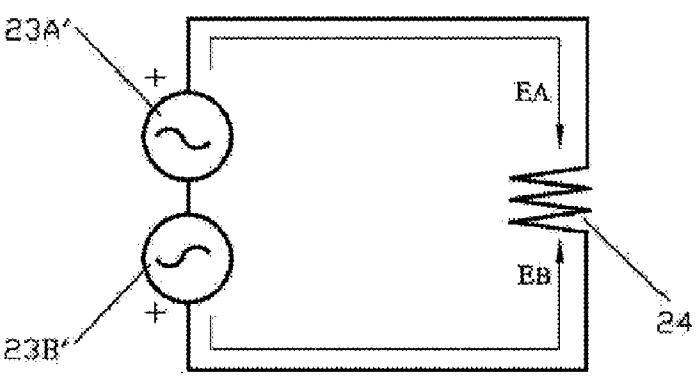
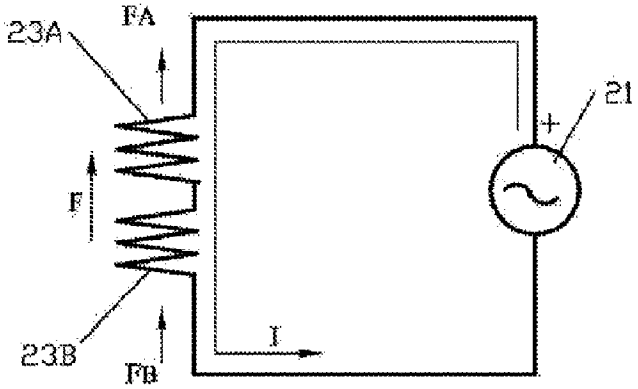
FIG. 24
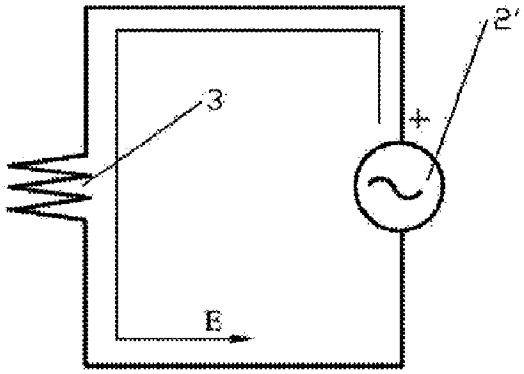
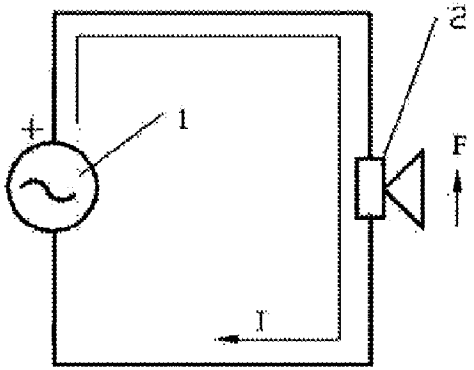
FIG. 23

INNER MAGNETIC TRANSDUCER WITH MULTIPLE MAGNETIC GAPS AND MULTIPLE COILS AND PREPARATION METHOD THEREOF

BACKGROUND

1. Field of the Invention

The present invention, which belongs to the field of electroacoustic transducers and mechanical-electrical transducers in electricity, relates to a transducer and in particular to an inner magnetic transducer with multiple magnetic gaps and multiple coils.

2. Background of the Related Art

During one-hundred-thirty years since the world's first moving-coil speaker (hereinafter referred to as speaker) was granted for a patent for invention in 1877, almost all the speakers of commercial production are equipped with only one magnetic gap and one coil, except those as disclosed by the invention patents of U.S. Pat. No. 5,849,760 in the name of USA HARMAN Company, CN951010204 in the name of JAPAN ALPINE Company, and CN99114781.2, CN00122197.3, U.S. Pat. No. 6,795,564 and TW88109796 in the name of the present inventor and the like. When the coil is connected to an audio signal current, a left-handed electrodynamic force F is generated under interaction with the magnetic field of the magnetic gap according to the Fleming's left-hand rule, such that the coil and the vibrating membrane is driven to take piston-like reciprocation and sounds are produced due to air vibration. However, at the same time when the coil reciprocates like a piston, according to the Fleming's right-hand rule, the permanent magnetic lines within the magnetic gap will cut perpendicularly the coil to thereby induce an electric generator potential within the same coil, namely, a so-called back electromotive force of a speaker by the electroacoustic technical field. As the vector of the back electromotive force has a difference in phase angle of 180 degrees with the vector of the audio input signal (ignoring the inductance and wire-to-wire capacitance of the coil), they are superposed within the same coil, and the back electromotive force necessarily incurs distortion during electroacoustic restoration of the speaker. Obviously, it is an undesirable yet inextricable physical phenomenon.

Generally, the greater the relatively moving speed, the relatively moving range and the inductance of the coil of the speaker are, the lower the frequency of the audio signal current while the larger the amplitude of the back electromotive force become, with a result that a greater distortion is incurred. Thus, it is impossible or unwilling for the prior art to improve the sensitivity of the speaker, i.e. the electroacoustic conversion efficiency, so as to prevent the troublesome back electromotive force from incurring serious distortion. Even the back electromotive force of a professional speaker when being operated under a big, high-powered dynamic signal, may breakdown and destroy the power amplifier tube at the final stage of the power amplifier.

During one hundred and thirty years, in face of such a worldwide technical difficulty remaining unsolved in the electroacoustic field, people can but choose a passive technical solution to fetch up this difficulty, namely, reducing the electroacoustic conversion efficiency (i.e. sensitivity) as much as possible on one hand, and meanwhile enhancing the input power of the speaker as much as possible on the other hand, such that the ratio between the absolute value of the back electromotive force and the input audio signal is decreased to thereby limit the distortion caused by the back electromotive force at a commonly acceptable level. It is why some Hi-Fi speakers, even some Hi-end speakers under world-famous trademarks, cannot be promoted by power amplifiers.

Secondly, the other fatal drawback of the transducer with only one magnetic gap and only one coil is high heat generation incurred by a low efficiency.

Even if the adverse factor of back electromotive force is eliminated, the lower efficiency of the speaker is a further worldwide technical deficiency which puzzles the electroacoustic field for a long period of one hundred and thirty years.

For example, a speaker of 2-inch caliber has the electroacoustic conversion efficiency equal to or less than 0.10%. This means that, when the speaker is inputted with an audio power of 5 W, only the electric energy of 0.005 w is converted into the desired sound energy, and the rest 4.99 W is converted into useless and harmful heat and wasted. In this case, the efficiency of the speaker of 2-inch caliber is equivalent to about 1/70-1/80 of the efficiency of an incandescent lamp.

A professional speaker of 15-inch large caliber usually has a SPL-value of 98 dB/1 W/1 m, whose efficiency is 3.89%, less than one half of the efficiency of the incandescent lamp. There are hundreds of billions of speakers in the modern society, and almost all of them are operated at super low efficiencies (only except the "speakers" in the field of thermoacoustic refrigeration). They waste a large amount of energy of the human society, while increase the discharge amount of carbon dioxide drastically.

The third drawback of the transducer with a single magnetic gap and a single coil is that, due to the T-iron structure of the magnetic path, the narrow magnetic gap has a sealed back chamber at the bottom. When the coil reciprocates like a piston in the magnetic gap, the air accumulated in the back chamber forms an airbag damping against the coil, which deteriorates the instantaneous response of the speaker, which enhances the distortion of the speaker, and which decreases the fidelity in the course of electroacoustic restoration. Meanwhile, at the intersection of the T-iron and the lower polar plate, the flux density of the magnetic lines has already been saturated yet is far from being sufficiently utilized, rendering a further waste of the magnetic energy.

The fourth significant drawback of the transducer with a single magnetic gap and a single coil is that, generally, it is impossible to attain a full-range electroacoustic restoration effect by use of only one speaker. It is because that, the speaker has an inductance, whose impedance value is presented as a function of the audio current working efficiency. The lower said efficiency is, the lower the impedance becomes, and vice versa. That is to say, for every traditional speaker, the effective value of the high audio current flowing through the coil is much less than that of the low frequency audio current. Hence, the sound pressure generated by the speaker when being operated at the high audio section obviously decreases with respect to the low audio section. Of course, for a speaker with a caliber no more than 3-inch, it is possible to fetch up this deficiency by technical means as the vibrating quality of the system is relatively light. However, a speaker of relatively small caliber must have a relatively higher Fo, and thus it is hard for the speaker to produce a satisfactory low audio effect. For a speaker with a caliber no less than 3-inch, Fo tends to the low audio section as a result of the increased caliber, such that the low audio electroacoustic restoration quality of the speaker is improved. However, along with the increased caliber, the quality of the vibrating system increases synchronously, rendering a great decrease in the audio section of 5-10 KHz for the output sound pressure in the high audio section of the speaker.

For this reason, people have to assemble a bass speaker, a middle speaker and a high speaker into a speaker system by a crossover network so as to attain a relatively satisfactory electroacoustic restoration effect. However, the introduction of the crossover network not only accelerates the consumption of electric energy, but also brings forth new higher harmonic restorations within those frequency bands near the crossover points.

Hence, people try to change the structure mode of a traditional speaker with a single magnetic gap and a single coil, and several new technical solutions about a transducer with multiple magnetic gaps and multiple coils have been proposed.

For example, in the prior art, USA HARMAN Company has proposed, in its invention patent U.S. Pat. No. 5,748,760 (PCT/US95/14696, WO96/33592), a driver for (a transducer with) double magnetic gaps and double coils using a multi-functional frame. However, it has the following drawbacks: first of all, the front polar plate, the rear polar plate and the neodymium magnet are provided with central axial holes. For the transducers of mini-type and the speakers with small or middle calibers, the effective dimension of the neodymium magnet and its magnetic energy are subjected to unreasonable restraints. Therefore, the invention is unavailable for the widely-applied series of speakers of mini-type and speakers with small or middle calibers. Secondly, the patent U.S. Pat. No. 5,748,760 is silent to essential contents necessary for attaining a transducer possessed of resistance load characteristics. Thirdly, this patent, when applied in high-power transducers, arranges center plats at the central axial holes of the polar plates and the neodymium magnet for guiding the coil's wire out. This finally loses a direct pneumatic heat-dissipating passage for huge heat generated by the transducer. Fourthly, the electroacoustic conversion efficiencies of the products with the patent U.S. Pat. No. 5,748,760 (for example, the speaker units in EON voice boxes from USA JBL Company) are not significantly improved in comparison with those traditional speakers using the iron strontium oxide.

UK NXT Company has also proposed, in its patent application PCT/GB00/01484 (CN1347628A), a driver for an inner magnetic transducer with multiple magnetic gaps and multiple coils. However, it has the following drawbacks: the patent application fails to disclose the entire technical solution for forming a driver with multiple magnetic gaps and multiple coils. Moreover, it falls into the range covered by the claims of the patent CN2333135Y, and the inventor's patent CN97205593.2 and patent applications PCT/CN98/00306 (WO99/31931) and CN1219834A. In addition, the method of calculating the coil inductance in the speaker with a permanent magnet and an iron-core circuit by use of the Welsby's formula, and its corresponding conclusion, as raised by the above patent application, cannot be established.

The present inventor, in his patent CN200520035371.X and patent applications PCT/CN98/00306, CN99114781.2, US2005/0099255 and CN1741683A, has also proposed several kinds of inner magnetic transducers which have multiple coils and multiple magnetic gaps, and which are possessed of resistance load characteristics, or characteristics similar thereto. However, they have the following drawbacks: first of all, these technical solutions fail to give full definitions upon the technical features in the symmetrical magnetic paths and symmetrical coil circuits of the transducers. Secondly, the bracket made of non-magnetic material encloses the entire magnetic paths from upside to downside, which inevitably increases the weight, the complex of the entire structure and the production cost of the transducer. Thirdly, the patent applications fail to give necessary, sufficient disclosure and description upon how the back electromotive back is eliminated from the transducer. Fourthly, when the two end surfaces of the annular magnetic yoke are flush with the outer polar surfaces of the upper and lower polar plates, as shown in FIG. 12, it is inevitable to increase the asymmetry of the magnetic path and thus enhance the distortion of the transducer accordingly.

JAPAN SONY Company, in its patent application JP2006050245 (CN1735282, US2006029238, DE102005036538), has proposed an apparatus and a method for eliminating the back electromotive force in a transducer. However, in order to eliminate the signal distortion caused by the back electromotive force, it has to add a distortion rectifying circuit consisting of three electronic amplifiers for every speaker.

BRIEF SUMMARY

It is a first object of the present invention to overcome the deficiencies in the prior art, by way of providing a plurality of inner magnetic transducers with multiple magnetic gaps and multiple coils, which are simple in structure and which are possessed of high sensitivity, high analytic capability and high fidelity, wherein the transducer utilizes its own two groups of symmetrical magnetic paths and symmetrical coil circuits to eliminate the inductances and the back electromotive forces of the coils automatically.

It is a second object of the present invention to overcome the deficiencies in the prior art, by way of providing a preparation method for mass production of an inner magnetic transducer with multiple magnetic gaps and multiple coils.

The objects of the present invention are achieved by the followings:

An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the magnetic path comprises a upper polar plate and a lower polar plate which are co-axially mounted, one axially-magnetized permanent magnet or more than one axially-magnetized permanent magnets of the same thickness is sandwiched between the upper polar plate and the lower polar plate, the two polar plates have the same projected area and match with the permanent magnet, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner circumferential surface or the outer circumferential surface of the annular thin wall, a smooth and well-defined vertical positioning surface is further arranged, the upper and lower polar plate, and the permanent magnet is adhesively fixed onto the axial center of the circular platform surface of the bracket, an annular magnetic yoke being co-axially mounted with the upper and lower polar plates and the permanent magnet, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, two co-axial annular magnetic gaps of the same diameter are formed between the inner circumferential surface of the annular magnetic yoke and the vertical circumferential surfaces of the upper and lower polar plates;

two of said coils, which are co-axially mounted, are inserted into the annular magnetic gaps, said coils are formed by winding one or two layers of electromagnetic wires, a corresponding space is arranged between the two coils, and the winding directions of the two coils and the directions of current flowing through the two coils are set such that the two coils generate electrodynamic forces F of the same direction at the same working instant;

the transducer has two groups of magnetic paths which are vertically and horizontally symmetrical in terms of geometrical shape and magnetic performance, with the central axis of the upper and lower plates and the permanent magnet as the vertical symmetrical axis, and with the halving line X-X axis at the half axial height of the permanent magnet as the horizontal symmetrical axis;

the two coils are set identical to each other in terms of the cross-sectional area of electromagnetic wires, the number of turns, the winding extent, the resistance, the absolute value of inductance and the tensile force during winding and thus form two groups of vertically symmetrical coil circuits by taking the halving line X-X axis at the half axial height of the permanent magnet as the horizontal symmetrical axis, the inductances of the two coils and the back electromotive forces induced in course of their reciprocating movements are cancelled out due to a difference in phase angle of 180 degrees, and hence the transducer is an inner magnetic transducer with multiple magnetic gaps and multiple coils which has resistance load characteristics or approximately resistance load characteristics and has high sensitivity, high analytic capability and high fidelity.

An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the magnetic path comprises a upper polar plate and a lower polar plate which are co-axially mounted and which are provided with central axial holes, an axially-magnetized ring-shaped permanent magnet or more than one sector-like or disc-like permanent magnets of the same thickness is sandwiched between the upper polar plate and the lower polar plate, the two polar plates have the same projected area and match with the permanent magnet, a bracket is made of non-magnetic material and provided with an inwardly convex circular platform at the axial center thereof, the axial center of the circular platform is provided with an axial hole, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner circumferential surface or the outer circumferential surface of the annular thin wall, a smooth and well-defined vertical positioning surface is further arranged, a fastener, which is made of non-magnetic material penetrates through the circular axial holes of the upper and lower polar plates, the permanent magnet and the bracket, and jointly fixes them on the axial center of the circular platform surface of the bracket, an annular magnetic yoke being co-axially mounted with the upper and lower polar plates and the permanent magnet, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, two co-axial annular magnetic gaps of the same diameter are formed between the inner circumferential surface of the annular magnetic yoke and the vertical circumferential surfaces of the upper and lower polar plates;

two of said coils, which are co-axially mounted, are inserted into the annular magnetic gaps, said coils are formed by winding one or two layers of electromagnetic wires, a corresponding space is arranged between the two coils, and the winding directions of the two coils and the directions of current flowing through the two coils are set such that the two coils generate electrodynamic forces F of the same direction at the same working instant;

the transducer has two groups of magnetic paths which are vertically and horizontally symmetrical in terms of geometrical shape and magnetic performance, with the central axis of the upper and lower plates and the permanent magnet as the vertical symmetrical axis, and with the halving line X-X axis at the half axial height of the permanent magnet as the horizontal symmetrical axis;

the two coils are set identical to each other in terms of the cross-sectional area of electromagnetic wires, the number of turns, the winding extent, the resistance, the absolute value of inductance and the tensile force during winding and thus form two groups of vertically symmetrical coil circuits by taking the halving line X-X axis at the half axial height of the permanent magnet as the horizontal symmetrical axis, the inductances of the two coils and the back electromotive forces induced in course of their reciprocating movements are cancelled out due to a difference in phase angle of 180 degrees, and hence the transducer is an inner magnetic transducer with multiple magnetic gaps and multiple coils which has resistance load characteristics or approximately resistance load characteristics and has high sensitivity, high analytic capability and high fidelity.

An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted on respective outer surfaces of the two permanent magnets to constitute a pair of repellent-type magnets, the three polar plates, which are co-axially mounted, have the same projected area and match with the two permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, three co-axial annular magnetic gaps of the same diameter;

three of said coils, which are co-axially mounted, are inserted into the annular magnetic gaps, said coils are formed by winding one or two layers of electromagnetic wires, corresponding spaces are arranged between the three coils, and the winding directions of the three coils and the directions of current flowing through the three coils are set such that the three coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate polar plate of the repellent-type magnets as the horizontal symmetrical axis;

when the two outer coils 309A and 309C have a clockwise winding direction as viewed from the outerside direction of the vibrating membrane, the intermediate coil 309B must have a counter-clockwise winding direction, and vice versa, the tail YA of the coil 309A is serially connected with the head XB of the coil 309B, the tail YB of the coil 309B is serially connected with the head XC of the coil 309C, the tail YC of the coil 309C is upwardly and vertically guided along the coil bobbin 307 to form, together with the head XA of the coil 309A, a pair of signal input terminals of the transducer, the three coils 309A, 309B and 309C are set to have the same cross-sectional area of the electromagnetic wires and tensile force during winding, the coils 309A and 309C are set to have the same number of turns, winding extent, resistance and absolute value of inductance, and the number of turns, winding extent, resistance and absolute value of coil inductance of the coil 309B are set to be identical to the corresponding sums of the numbers of turns, winding extents, resistances, absolute values of inductance of the two coils 309A, 309C, so as to form two groups of vertically symmetric coil circuits with the halving line X-X axis at the half axial height of the intermediate plate as the horizontal symmetrical axis, the inductances of the three coils and the back electromotive forces induced by their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted on respective outer surfaces of the two permanent magnets to constitute a pair of repellent-type magnets, the three polar plates, which are co-axially mounted, have the same projected area and match with the two permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, three co-axial annular magnetic gaps of the same diameter;

three of said coils, which are co-axially mounted, are inserted into the annular magnetic gaps, said coils are formed by winding one or two layers of electromagnetic wires, corresponding spaces are arranged between the three coils, and the winding directions of the three coils and the directions of current flowing through the three coils are set such that the three coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate polar plate of the repellent-type magnets as the horizontal symmetrical axis;

when the two outer coils 309A' and 309C' have a clockwise winding direction as viewed from the outerside direction of the vibrating membrane, the intermediate coil 309B' must have a counter-clockwise winding direction, and vice versa, a central tap YB' is disposed at the a half number of turns of the coil 309B' to constitute two equally-divided coils 309B1' and 309B2', the tail YA' of the coil 309A' is serially connected with the head XB1' of the coil 309B1', the head XC' of the coil 309C' is serially connected with the tail YB2' of the coil 309B2', the tail YC' of the coil 309C' is in parallel connected with the head XA' of the coil 309A' and then is upwardly and vertically guided, together with the central tap terminal YB' of the coil 309B', along the coil bobbin to form a pair of signal input terminals of the transducer, the coil 309A' and the coil 309B1', as well as the coil 309C' and the coil 309B2', are identical to each other in terms of the cross-sectional area of the electromagnetic wires, the number of turns, the winding extent, the resistance, the absolute value of inductance and the tensile force during winding so as to form two groups of vertically symmetrical coil circuits with the halving line X-X axis at the half axial height of the intermediate polar plate as the horizontal symmetrical axis, the inductances of the four coils and the back electromotive forces induced from their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted onto respective outer surfaces of the two permanent magnets to constitute two or more pairs of repellent-type magnets, the four or more polar plates, which are co-axially mounted, have the same projected area and match with the three or more permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, four or more co-axial annular magnetic gaps of the same diameter;

four or more of said coils, which are co-axially mounted, are inserted into the annular magnetic gaps, said coils are formed by winding one or two layers of electromagnetic wires, corresponding spaces are arranged between the four or more coils, and the winding directions of the four or more coils and the directions of current flowing through the four or more coils are set such that the four or more coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate permanent magnet or the intermediate polar plate of the repellent-type magnets as the horizontal symmetrical axis;

when the two outer coils 609A and 609D have a clockwise winding direction and a counter-clockwise winding direction, respectively, as viewed from the outside of the vibrating membrane, the intermediate two coils 609B and 609C must have a counter-clockwise winding direction and a clockwise winding direction, correspondingly, and vice versa, the tail YA of the coil 609A is serially connected with the head XB of the coil 609B, the tail YB of the coil 609B is serially connected with the head XC of the coil 609C, the tail YC of the coil 609C is serially connected with the head XD of the coil 609D, and the tail YD of the coil 609D is guided upwardly and vertically along the coil bobbin to form, together with the head XA of the coil 609A, a pair of signal input terminals of the transducer, the coils 609A and 609D, as well as the coils 609B and 609C, of the four coils, are identical to each other in terms of the cross-sectional area of electromagnetic lines, the number of turns, the winding extent, the resistance, the absolute value of inductance and the tensile force during winding so as to form two groups of vertically symmetrical coil circuits, with the halving line X-X axis at the half axial height of the intermediate permanent magnet as the horizontal symmetrical axis, the inductances of the four coils and the back electromotive forces induced from their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

An inner magnetic transducer with multiple magnetic gaps and multiple coils, characterized in that, the permanent magnet is a Nd—Fe—B magnet.

An inner magnetic transducer with multiple magnetic gaps and multiple coils, characterized in that, the bracket is made of aluminium alloy, non-magnetic stainless steel, or engineering plastic.

A preparation method for an inner magnetic transducer with multiple magnetic gaps and multiple coils, comprising:

a tubular tooling 01 made of non-magnetic material, with one end having an inner diameter 1D1 and a height 1H1, and a coaxial inner diameter 1D2 and a height 1H2, the inner diameter 1D1 being 0.01-0.5 mm less than the inner diameter 1D2, the height 1H1 being 0.1-2 mm less than the thickness of the permanent magnet, and the height 1H2 being identical to the thickness of the polar plate, the tubular sections 1H1 and 1H2 having smooth and well-defined inner circular surfaces and horizontal positioning surfaces 0110, 0120 and 0130 which orthogonally intersect the central axis of the tubular tooling 01;

embedding a permanent magnet of the transducer into the tubular section having the inner diameter 1D1 of the tubular tooling 01 to be stopped by the horizontal positioning surface 0110, the inner diameter 1D1 having a fit tolerance of positive 0.02-0.05 mm with respect to the diameter of the permanent magnet, and then embedding a polar plate of the transducer into the tubular section having the inner diameter 1D2, the inner diameter 1D2 having a fit tolerance of positive 0.02-0.05 mm with respect to the diameter of the polar plate, and then coating the coinciding polar surface of one of the permanent magnet and the polar plate with an adhesive and meanwhile applying a pressing force thereonto, and then removing the tubular tooling 01 once the adhesive is cured, so as to attain a permanent magnet and a polar plate which are co-axially adhesively fixed;

a tubular tooling 02 made of non-magnetic material, with one end having a thin-walled tubular section with an inner diameter 2D1 and a height 2H1, the inner diameter 2D1 having a fit tolerance of positive 0.01-0.05 mm with respect to the outer circular diameter of the polar plate and the inwardly convex circular platform of the bracket, the tubular section 2H1 being identical to or slightly less than the total thickness of the polar plate and the permanent magnets or the repellent-type magnet(s) or the repellent-type magnets of the transducer and having smooth and well-defined inner and outer circular surfaces, the tubular tooling 02 having horizontal positioning surfaces 0210 and 0220 which orthogonally intersect the central axis of the tubular tooling;

embedding the permanent magnet and the polar plate, which are co-axially adhesively fixed, into the tubular section having the inner diameter 2D1 and allowing one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface 0210 of the tubular tooling 02, and then removing the tubular tooling 02 once the adhesive is cured, so as to attain two polar plates and a permanent magnet sandwiched therebetween which are co-axially adhesively fixed together;

magnetizing the permanent magnet and the polar plates which are co-axially adhesively fixed or only the permanent magnet by a proper magnetizing machine, and then alternately using the tubular toolings 01 and 02 so as to attain repellent-type magnets with 3-4 polar plates and 2-3 permanent magnets which are co-axially adhesively fixed together;

a bracket 03 which is made of non-magnetic material, with an inwardly convex circular platform at its axial center, the outer diameter 3D1 of the circular platform being less, in a negative tolerance of 0.01-0.05 mm, than the diameter of the polar plate, and having a fit tolerance of negative 0.01-0.05 mm with respect to the inner diameter 2D1 of the tubular tooling 02, at a corresponding axial height of the annular thin wall of the bracket, there being further provided a smooth and well-defined horizontal positioning surface 0330, the inner circular diameter 3D2 of the annular thin wall having a fit tolerance of positive 0.1-2 mm with respect to the outer diameter of the annular magnetic yoke, applying the adhesive onto the inwardly convex circular platform 0300, and then placing on the adhesive the polar plates and the permanent magnets or the repellent-type magnets which have already been co-axially adhesively fixed and magnetized, and then embedding them into the inner wall of the tubular tooling 02, the inner wall of the tubular tooling 02 being smoothly fit and secured with the vertical outer circular surface 0310 of the inwardly convex circular platform, the horizontal positioning surface 0210 closely abutting against the outer polar surface of the polar plate and applying a pressing force, and once the adhesive is cured, the polar plates and the permanent magnet or the repellent-type magnets are adhesively secured to the axial center of the circular platform surface 0300 of the bracket;

pre-coating the adhesive onto the horizontal positioning surface 0330 or the vertical positioning surface 0320 of the bracket, and then nesting the annular magnet yoke of the transducer from outer end 2D3 of the tubular tooling 02, and then inwardly sliding the annular magnet yoke along the smooth outer circular surface of the tubular section, when the annular magnet yoke reaches the polarized area of the permanent magnet, manually controlling the sliding speed of the annular magnetic yoke to finally stop it by the horizontal positioning surface 0330 of the bracket, removing the tubular tooling 02 once the adhesive is cured, so as to prepare two or more groups of symmetrical magnetic paths and two or more co-axial annular magnetic gaps of the same diameter;

embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin and two or more coils into the annular magnetic gaps, and then adhering in turns within the frame, one or two elastic damping plates, the coil bobbin, the vibrating membrane or the planar sound generating plate, so as to prepare an inner magnetic transducer with multiple magnetic gaps and multiple coils which has resistance load characteristics or approximately resistance load characteristics and has high sensitivity, high analytic capability and high fidelity.

A preparation method for an inner magnetic transducer with multiple magnetic gaps and multiple coils, comprising:

the polar plates and the permanent magnet(s) of the transducer with multiple magnetic gaps and multiple coils are provided with central axial holes of the same diameter at the respective axial centers thereof;

a tubular tooling 01 which is made of non-magnetic material, with one end having an inner diameter 1D1 and a height 1H1, and a coaxial inner diameter 1D2 and a height 1H2, the inner diameter 1D1 being 0.01-0.5 mm less than the inner diameter 1D2, the height 1H1 being 0.1-2 mm less than the thickness of the permanent magnet, and the height 1H2 being identical to the thickness of the polar plate, the tubular sections 1H1 and 1H2 having smooth and well-defined inner circular surfaces and horizontal positioning surfaces 0110, 0120 and 0130 which orthogonally intersect the central axis of the tubular tooling 01;

embedding one of the permanent magnets of the transducer into the tubular section having the inner diameter 1D1 of the tubular tooling 01 to be stopped by the horizontal positioning surface 0110, the inner diameter 1D1 having a fit tolerance of positive 0.02-0.05 mm with respect to the diameter of the permanent magnet, and then embedding one of the polar plates of the transducer into the tubular section having the inner diameter 1D2, the inner diameter 1D2 having a fit tolerance of positive 0.02-0.05 mm with respect to diameter of the polar plate, and then coating the coinciding polar surface of one of the permanent magnet and the polar plate with an adhesive and meanwhile applying a pressing force thereonto, and then removing the tubular tooling 01 once the adhesive is cured, so as to attain a permanent magnet and a polar plate which are co-axially adhesively fixed and which have central axial holes;

a tubular tooling 02 which is made of non-magnetic material, with one end having a thin-walled tubular section with an inner diameter 2D1 and a height 2H1, the inner diameter 2D1 having a fit tolerance of positive 0.01-0.05 mm with respect to the outer circular diameter of the polar plate and the inwardly convex circular platform of the bracket, the tubular section 2H1 being identical to or slightly less than the total thickness of the polar plate and the permanent magnet(s) or the repellent-type magnet(s) of the transducer and having smooth and well-defined inner and outer circular surfaces, the tubular tooling 02 having horizontal positioning surfaces 0210 and 0220 which orthogonally intersect the central axis of the tubular tooling;

embedding the permanent magnet and the polar plate which are co-axially adhesively fixed into the tubular section having the inner diameter 2D1 and arranging one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface 0210 of the tubular tooling 02, and then removing the tubular tooling 02 once the adhesive is cured, so as to attain two polar plates and a permanent magnet sandwiched therebetween which are co-axially adhesively fixed together and which have axial holes;

magnetizing the permanent magnet and the polar plates which are co-axially adhesively fixed or magnetizing only the permanent magnet by a proper magnetizing machine, and then alternately using the tubular toolings 01 and 02 so as to attain repellent-type magnets with 3-4 polar plates and 2-3 permanent magnets which are co-axially adhesively fixed together;

a bracket 04 which is made of non-magnetic material, with an inwardly convex circular platform at its axial center, the axis of the circular platform being provided with a central axial hole which is matched with the axial holes of the pole plates and the permanent magnet, and an associated quadrangular or hexagonal concave hole, the outer diameter 4D1 of the circular platform being less, in a negative tolerance of 0.01-0.05 mm, than the diameter of the polar plate, and having a fit tolerance of negative 0.01-0.05 mm with respect to the inner diameter 2D1 of the tubular tooling 02, at a corresponding axial height of the annular thin wall of the bracket, there being further provided a smooth and well-defined horizontal positioning surface 0430, the inner circular diameter 4D2 of the annular thin wall having a positive tolerance of 0.1-2 mm with respect to the outer diameter of the annular magnetic yoke, applying the adhesive onto the inwardly convex circular platform 0400, and then placing on the adhesive the polar plates and the permanent magnet(s) or the repellent-type magnets which have already been co-axially adhesively fixed, and magnetized, and embedding them into the inner wall of the tubular tooling 02, the inner wall of the tubular tooling 02 being smoothly fit and secured with the vertical outer circular surface 0410 of the inwardly convex circular platform, and meanwhile inserting a non-magnetic material fastener into the central axial holes of the polar plates, the permanent magnets, and the bracket, the horizontal positioning surface 0210 of the tubular tooling 02 closely abutting against the outer polar surface of the polar plate and applying a pressing force, and once the adhesive is cured, the polar plates and the permanent magnet(s) or the repellent-type magnets are adhesively secured to the axial center of the circular platform surface 0400 of the bracket;

pre-coating the adhesive onto the horizontal positioning surface 0430 or the vertical positioning surface 0320 of the bracket, and then nesting the annular magnet yoke of the transducer from outer end 2D3 of the tubular tooling 02 and inwardly sliding the annular magnet yoke along the smooth outer circular surface of the tubular section, when the annular magnet yoke reaches the polarized area of the permanent magnet, manually controlling the sliding speed of the annular magnetic yoke to finally limit it by the horizontal positioning surface 0430 of the bracket, and then removing the tubular tooling 02 once the adhesive is cured, so as to prepare two or more groups of symmetrical magnetic paths and two or more co-axial annular magnetic gaps of the same diameter;

embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin and two or more coils into the annular magnetic gaps, and then adhering in turns within the frame, one or two elastic damping plates, the coil bobbin, the vibrating membrane or the planar sound generating plate, so as to prepare an inner magnetic transducer with multiple magnetic gaps and multiple coils which has resistance load characteristics or approximately resistance load characteristics and has high sensitivity, high analytic capability and high fidelity.

BRIEF DESCRIPTION OF THE DRAWINGS

FIG. 9 is a longitudinal section view of Embodiment 8 according to the present invention.

FIGS. 10-A, 10-B are longitudinal section views of the polar plates and the permanent magnet in Embodiment 9 according to the present invention.

FIGS. 14-A, 14-B, 14-C and 14-D are schematic views showing the waveforms of the audio signals and the back electromotive forces in two groups of symmetrical coil circuits according to the present invention.

FIG. 16 is a diagram showing schematically a first wiring of the coil circuits of a transducer with three magnetic gaps and three coils according to the present invention.

FIG. 17 is a diagram showing schematically a second wiring of the coil circuits of a transducer with three magnetic gaps and three coils according to the present invention.

FIG. 23 is a schematic view showing the working principle of the audio current and the back electromotive force in a prior art transducer with a single magnetic gap and a single coil.

FIG. 24 is a schematic view showing the working principle of the audio currents and the back electromotive forces in a transducer with multiple magnetic gaps and multiple coils that has symmetrical magnetic paths and symmetrical coil circuits according to the present invention.

DETAILED DESCRIPTION

Figure 1:
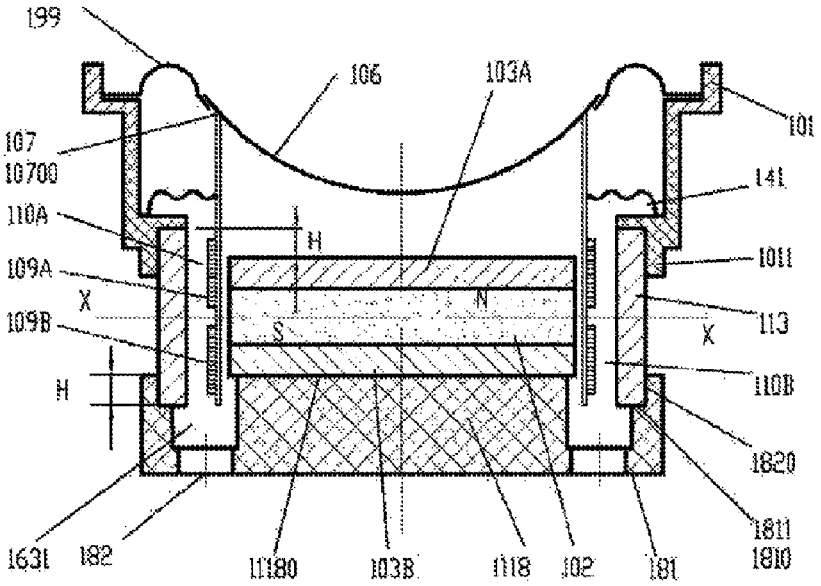
FIG. 1 is a longitudinal section view of Embodiment 1 according to the present invention.
Figure 2:
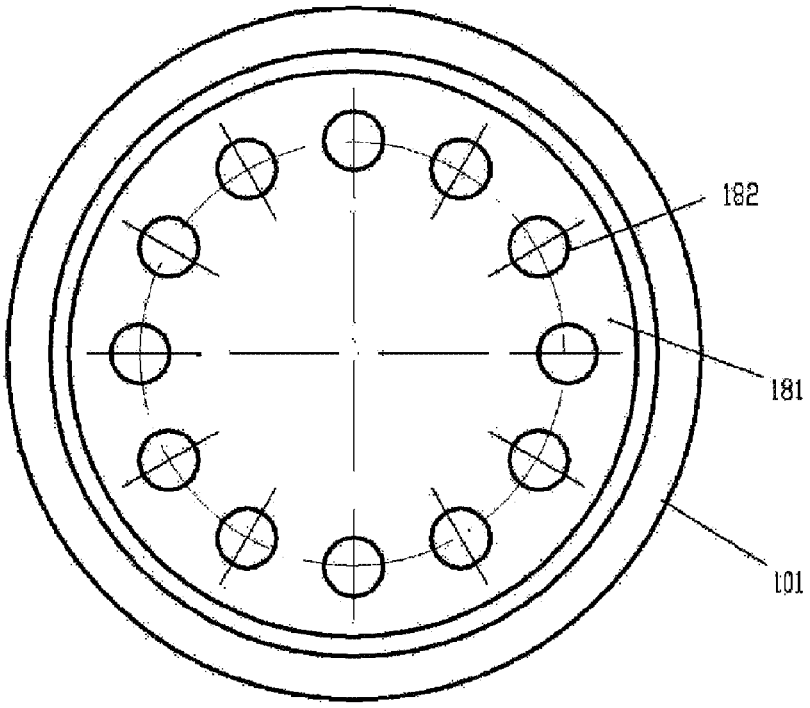
FIG. 2 is a rear view of Embodiment 1 according to the present invention.

FIG. 1 shows a longitudinal section view of Embodiment 1 according to the present invention. It is an embodiment of an inner magnetic speaker with double magnetic gaps and double coils. The upper polar plate 103A and the lower polar plate 103B are two circular flat plates which have the same thickness and the same projected area and which are mounted coaxially, and a Nd—Fe—B magnet 102 is sandwiched between the elements 103A and 103B. At the axial center of a bracket 181 made of aluminium-alloy, there is arranged an inwardly convex circular platform 1118, with a smooth and well-defined vertical outer circular surface and with 0.01-0.05 mm of negative tolerance less in diameter than the elements 103A and 103B. The element 1118 is provided with an annular groove 1631 at its outerside, with twelve through holes 182 evenly disposed in the bottom of the groove. At the outerside the element 1631, there is an annular thin wall of the bracket which has smooth and well-defined inner and outer circular vertical surfaces. At a certain axial height of the annular thin wall of the bracket, a smooth and well-defined horizontal positioning surface 1810 and a positioning surface 1820 are further formed.

An adhesive is applied onto the horizontal table 11180 of the element 1118, and the elements 103A, 102 and 103B which have been magnetically polarized are placed thereonto, and then a tubular tooling of non-magnetic-permeability material is embedded into the outer circular vertical surface of the element 1118 and the outer circular vertical surfaces of the elements 103A, 102 and 103B so as to ensure that the latter is mounted and positioned at the axial center of the element 11180. Once the adhesive is cured, an annular cylindrical magnetic yoke 113 is nested to the outer circular surface of the tooling and slides from outside to inside until the lower end surface of the element 113 is stopped by the horizontal positioning surface 1810 of the element 181, the elements 113 and 181 are adhesively fixed by the pre-coated adhesive. The tooling is removed once the adhesive is cured. At this point, the upper and lower end surfaces of the element 113 have the same H-value (0.5-20 mm) as the outer polar surfaces of the elements 103A and 103B, respectively, and two co-axial annular magnetic gaps of the same diameter are formed between the inner circumferential surface of the element 113 and the vertical circumferential surfaces of the elements 103A and 103B. The upper end of the element 113 is embedded into the circular axial hole in the bottom of the plastic frame, and the outer wall of the element 113 is adhered by an adhesive to the flange 1011 at the bottom of the frame and fixed therewith.

Figure 15:
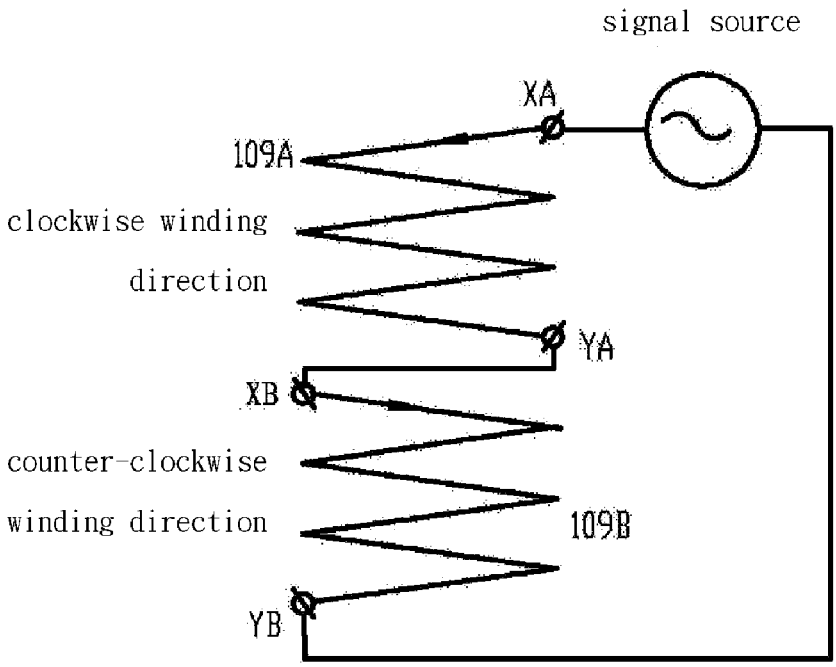
FIG. 15 is a diagram showing schematically the wiring of the coil circuits of a transducer with double magnetic gaps and double coils according to the present invention.
Figure 18:
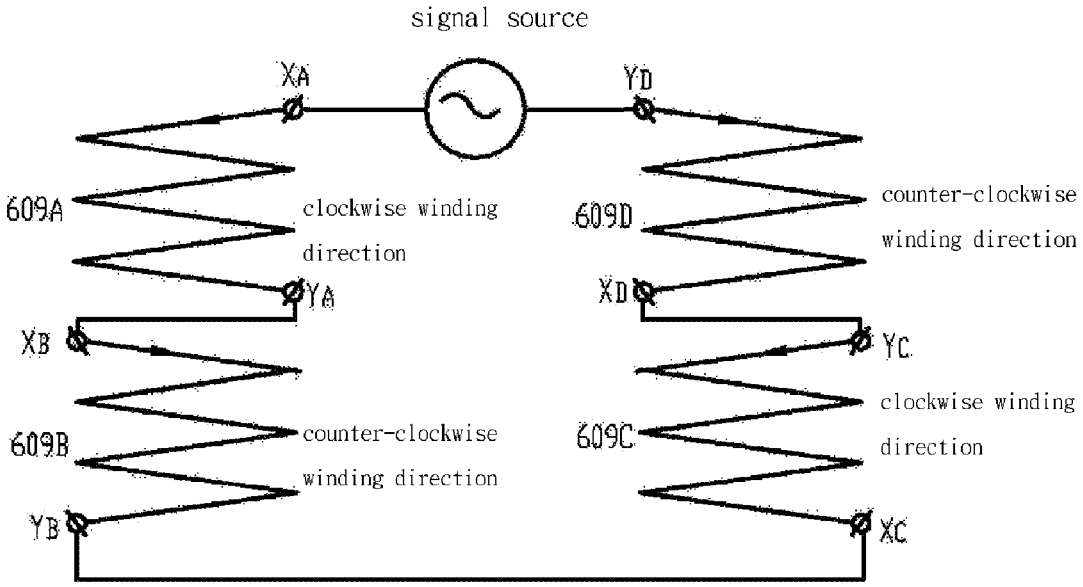
FIG. 18 is a diagram showing schematically the wiring of the coil circuits of a transducer with four magnetic gaps and four coils according to the present invention.

A coil bobbin 107 with coils 109A and 109B two co-axially installed thereto are inserted into the annular magnetic gaps. The two coils are formed by winding 1-2 layers of electromagnetic wires. As viewed from the direction of the vibrating membrane 106, the coil 109A is set to be have a clockwise winding direction and the coil 109B is set to have a counter-clockwise winding direction (vise versa). The cross-sectional area of electromagnetic wires, the number of turns, the winding extent, the resistance, the absolute value of inductance and the tensile force during winding the coils of the coils 109A and 109B are identical to each other, respectively. Therefore, two groups of magnetic paths and coil circuits, which are symmetrical vertically and horizontally in terms of geometrical shape and magnetic property, are formed with the X-X axis at the half axial height of the element 102 as the horizontal symmetrical axis and with the central axis of the elements 103A, 102 and 103B as the vertical symmetrical axis. The circuit-wiring schematic diagram of the two groups of coils refers to FIG. 15 of the present invention.

Further, the elastic damping plate 141, the coil bobbin 107, the vibrating membrane 106 and the frame 101 are adhesively fixed together, respectively. Whereby, in Embodiment 1 of the present invention, the inductances of the two groups of coils 109A and 109B and the back electromotive forces induced from their reciprocating movements are counteracted by each other, respectively, as they have a difference in phase angle of 180 degrees.

Figure 13:
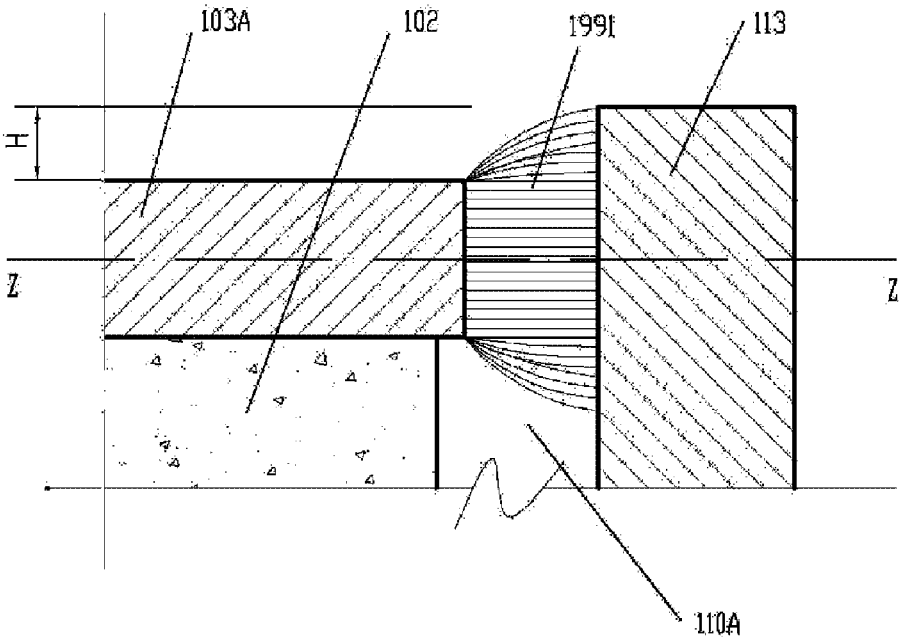
FIG. 13 is a schematic view showing the distribution of magnetic gap magnetic lines of the outer polar plate in a speaker according to the present invention.

Referring to FIG. 13, when the distances between the outer polar surfaces of the elements 103A and 103B and the corresponding end surfaces of the element 113 each are H and above zero, it is possible to attain two groups of magnetic paths with symmetrical magnetic gaps with the halving line Z-Z axis at the half axial heights of the elements 103A and 103B as the symmetrical axes as along as the H-value is selected properly according to the caliber of the transducer and the magnetic path. The lines of magnetic force in a magnetic gap are shown in FIG. 13. Hence, the speaker in the present embodiment is a transducer with multiple magnetic gaps and multiple coils which has resistance load characteristics or approximately resistance load characteristics and has high sensitivity, high analytic capability and high fidelity.

Figure 3:
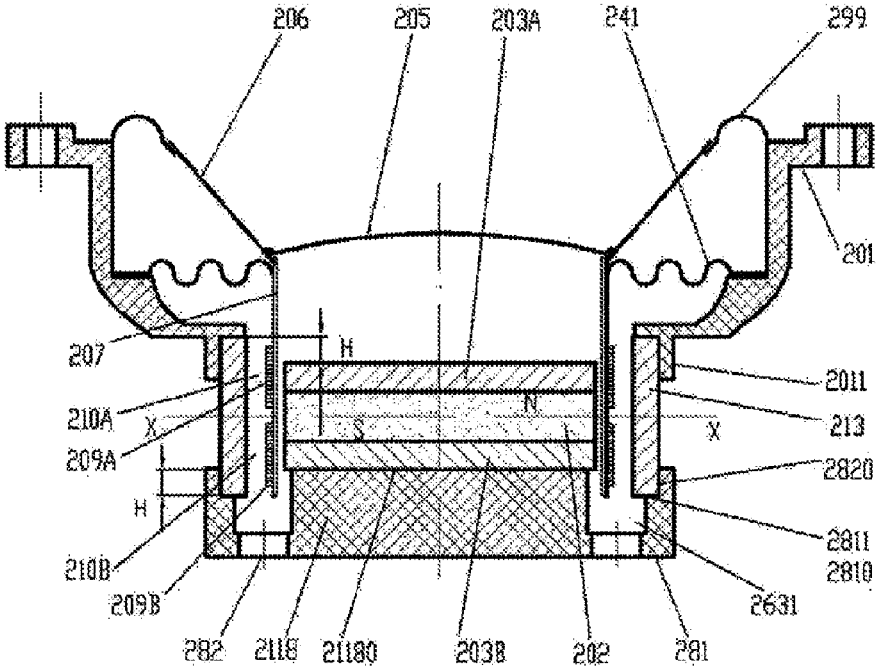
FIG. 3 is a longitudinal section view of Embodiment 2 according to the present invention.

FIG. 3 is a longitudinal section view of Embodiment 2 according to the present invention. It is an embodiment of an inner magnetic transducer with double magnetic gaps and double coils. The differences between this embodiment and Embodiment 1 are as follows: the inwardly concave vibrating membrane 106 in Embodiment 1 is substituted by the conical vibrating membrane 206 and the dust-proof cover 205 in Embodiment 2. Thus it can be seen that the structural form in Embodiment 2 is suitable for cone speakers of various calibers.

Except the above difference, Embodiment 2 is fully identical to Embodiment 1 in terms of structure, working principle and describing contents. Therefore, no repeated description will be given here.

Figure 4:
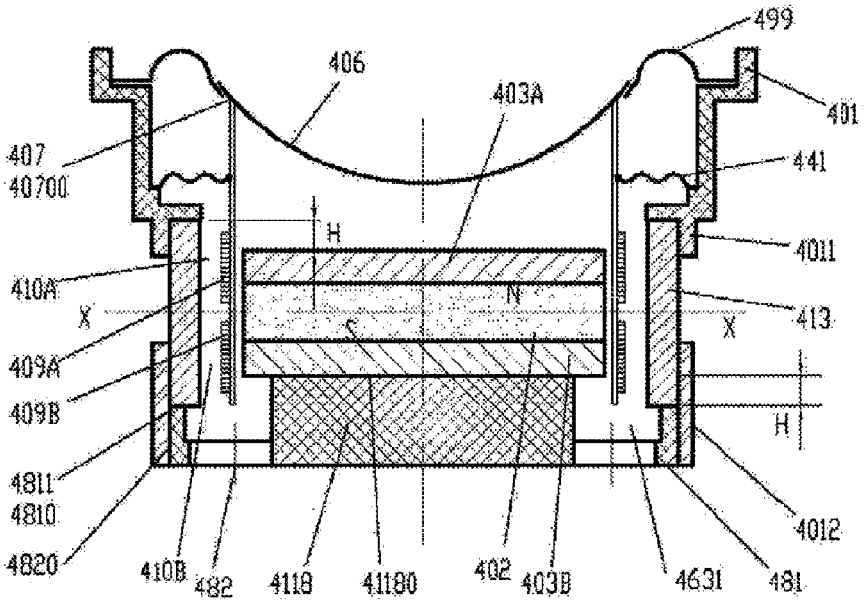
FIG. 4 is a longitudinal section view of Embodiment 3 according to the present invention.

FIG. 4 is a longitudinal section view of Embodiment 3 according to the present invention. It is an embodiment of an inner magnetic speaker with double magnetic gaps and double coils. A circular sleeve 4012 of non magnetic material such as aluminium alloy replaces a portion of the annular thin wall of the bracket in Embodiment 1 of the present invention. The upper section of the inner wall of the element 4012 is in interference fit with the magnetic yoke 413 in the shape of an annular cylinder or the annular thin wall of the bracket 481. The top end of the annular thin wall of the bracket 481 is provided with a smooth and well-defined horizontal positioning surface 4810. The lower end of the inner wall of the element 4012 is nested to the outer circumferential surface of the annular thin wall of the element 481 and they are adhesively fixed by adhesive. Thus it can be seen that Embodiment 3 just involves an equivalent change to the bracket in Embodiment 1 of the present invention: the element 4012, on substance, is of an expansion to annular thin wall of the bracket 481. Except this, Embodiment 3 is fully identical to Embodiment 1 of FIG. 1 as well as to Embodiment 2 of FIG. 3 in terms of structure, working principle and describing contents. Therefore, no repeated description will be given here.

Figure 5:
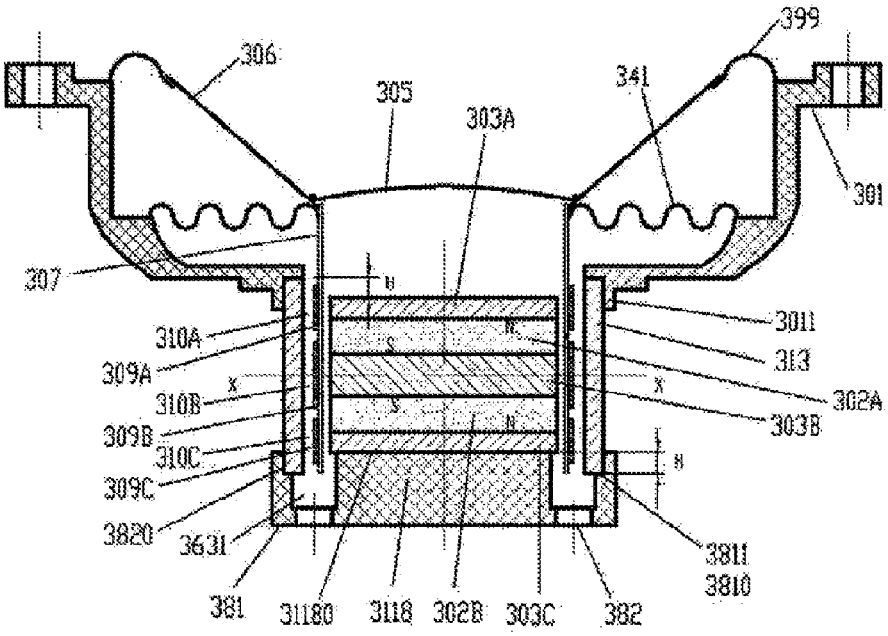
FIG. 5 is a longitudinal section view of Embodiment 4 according to the present invention.

FIG. 5 is a longitudinal section of Embodiment 4 according to the present invention. It is an embodiment of an inner magnetic speaker with three magnetic gaps and three coils. Onto two opposite surfaces of a circular polar plate 303B, two axially magnetized Nd—Fe—B magnets 302A and 302B are respectively mounted, and in turns two circular polar plates 303A and 303C are respectively mounted onto the outer surfaces of the permanent magnets 302A and 302B, the polarity (N-pole and S-pole) of the two permanent magnets are shown in FIG. 5. Three polar plates have the same projected area and are matched with the two permanent magnets. The elements 303A and 303C are equal in thickness, but the thickness of the element 303B is enough larger than that of the element 303A so as to ensure that the lines of magnetic force flowing therethrough are not saturated. Hence, a pair of co-axially mounted repellent-type magnets is formed. This pair of repellent-type magnets are disposed onto an inwardly concave circular platform surface 31180 of an aluminium alloy bracket 381 which is pre-coated with an adhesive, and then the elements 303A, 302A, 303B, 302B, 303C and the annular magnetic yoke 313 are co-axially mounted onto the axial center of the element 31180 by means of necessary tooling. In this case, the two upper and lower end surfaces of the element 313 have the same H-value (0.5-20 mm) with respect to the outer polar surfaces of the elements 303A and 303C, respectively. The inner circumferential surface of the element 313 forms, together with the vertical circumferential surfaces of the elements 303A, 303B and 303, three annular magnetic gaps 310A, 310B and 310C which are co-axial and identical in diameter. The upper end of the element 313 is adhesively fixed to the circular surface and plane formed by the inner flange 3011 of the frame. The lower end of the element 313 is embedded into the horizontal positioning surfaces 3810, 3820 of the bracket 381 and they are adhesively fixed by adhesive. After removing the tooling, a coil bobbin 307 with three coils 309A, 309B, 309C installed thereto are inserted into the annular magnetic gaps. The three coils are formed by winding 1-2 layers of electromagnetic wires. As viewed from the direction of the vibrating membrane 306, the coils 309A and 309C are set to be have a clockwise winding direction and the coil 309B is set to have a counter-clockwise winding direction (vise versa). The tail YA of the element 309A is in serial connected with the head XB of the element 309B, the tail YB of the element 309B is in serial connected with the head XC of the element 309C, and the tail YC of the element 309C is upwardly, vertically guided along the element 307 to form a pair of signal input terminals together with the head XA of the element 309A. The elements 309A, 309B and 309C are set to have the same cross-sectional area of the electromagnetic wires and tensile force during winding, the elements 309A and 309C are set to have the same number of turns, winding extent, resistance and absolute value of inductance, and the number of turns, winding extent, resistance and absolute value of coil inductance of the element 309B are respectively identical to the corresponding sums of the numbers of turns, winding extents, resistances, absolute values of inductance of the two elements 309A, 309C, respectively. Hence, two groups of symmetric magnetic paths and two groups of symmetrical coil circuits are formed with the central axis of the repellent-type magnets as the vertical symmetrical axis, and with the halving line X-X axis at the half axial height of the element 303B as the horizontal symmetrical axis. The detailed structure of the magnetic paths and the circuit-wiring schematic diagram of the three coils refer to FIG. 16A and FIG. 16B of the present invention showing a first schematic view of the wiring of the speaker with three magnetic gaps and three coils. Further, the elastic damping plate 341, the coil bobbin 307, the vibrating membrane 306 and the dangling edge 399, the dust-proof cover 305 and the frame 301 are adhesively fixed together. Hence, in Embodiment 4 of the present invention, the inductances of the three coils 309A, 309B and 30C and the back electromotive forces induced from their reciprocating movements are counteracted by each other, respectively, as they have a difference in phase angle of 180 degrees. The speaker in Embodiment 4 of the present invention is a transducer with multiple magnetic gaps and multiple coils which has resistance load characteristics or approximately resistance load characteristics and has high sensitivity, high analytic capability and high fidelity.

Except the above, Embodiment 4 is fully identical to Embodiment 1 of FIG. 1 in terms of structure, working principle and describing contents. Therefore, no repeated description will be given here.

FIGS. 17-A and 17-B are diagrams showing schematically a second wiring of the two groups of symmetrical coil circuits as mentioned in Embodiment 5 according to the present invention. This also an embodiment of a speaker with three magnetic gaps and three coils.

Embodiment 7 of FIG. 8 has the same frame, magnetic circuit structure and relevant describing contents as Embodiment 4, with only one difference in the wiring manner of the three coils as follows:

When the two outer coils 309A' and 309C' have a clockwise winding direction as viewed from the outerside direction of the vibrating membrane, the intermediate coil 308B' must have a counter-clockwise winding direction, and vice versa. It is set to dispose a central tap YB' at the a half number of turns of the coil 309B' to thereby constitute two equally-divided coils 309B1' and 309B2'. The tail YA' of the coil 309A' is in serial connected with the head XB1' of the coil 309B1', the head XC' of the coil 309C' is in serial connected with the tail YB2' of the coil 309B2', the tail YC' of the coil 309C' after it is in parallel connected with the head XA' of the coil 309A' is then upwardly, vertically guided together with the central tap terminal YB' of the coil 309B' along the coil bobbin 307 to form a pair of signal input terminals of the transducer. It is set that the coil 309A' and the coil 309B1', as well as the coil 309C' and the coil 309B2', are identical to each other in terms of the cross-sectional area of the electromagnetic wires, the number of turns, the winding extent, the resistance, the absolute value of inductance and the tensile force during winding, respectively. Therefore, two groups of vertically symmetrical coil circuits are formed with the halving line X-X axis at the half axial height of the intermediate polar plate 303B as the horizontal symmetrical axis. Hence, the inductances of the four coils and the back electromotive forces induced from their reciprocating movements are cancelled out, respectively, as they have a difference in phase angle of 180 degrees. The transducer is an inner magnetic transducer with multiple magnetic gaps and multiple coils which has resistance load characteristics or approximately resistance load characteristics and has high sensitivity, high analytic capability and high fidelity.

Except the above, Embodiment 7 is fully identical to Embodiment 4 of FIG. 5 in terms of structure, working principle and describing contents. Therefore, no repeated description will be given here.

Figure 6:
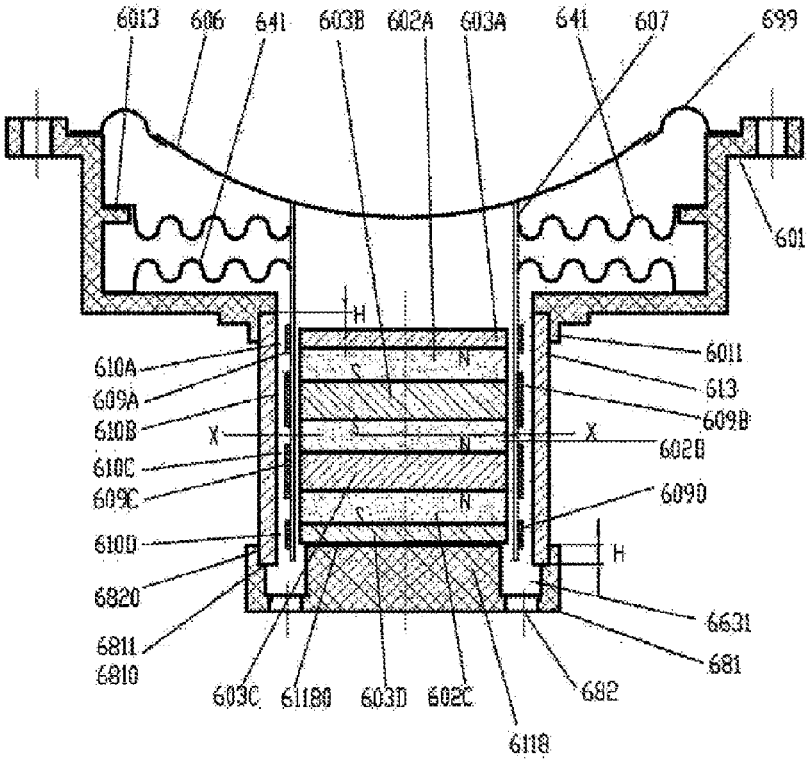
FIG. 6 is a longitudinal section view of Embodiment 5 according to the present invention.

FIG. 6 is a longitudinal section view of Embodiment 5 according to the present invention. It is an embodiment of an inner magnet speaker with four magnetic gaps and four coils. The frame is a frame 601 made of aluminium alloy, with at least two circular axial holes at the axial center of the frame 601. At different axial heights of the frame 601, annular platform surfaces with two elastic damping plates 641 installed thereto are arranged. Onto two opposite surfaces of a polar plate 603B of the magnetic path, axially magnetized Nd—Fe—B magnets 602A and 602B are respectively mounted. These permanent magnets have the same S-pole characteristics at the sides abutting the polar plate 603B. Polar plates 603A and 603C are in turns mounted onto the outer surfaces of the two permanent magnets 602A and 602B. At the outerside of the polar plate 603C, a further Nd—Fe—B permanent magnet 602C is installed, with a further polar plate 603D at the outerside of the element 602C, so as to form two pairs of repellent-type magnets (their polarities are shown in FIG. 6). Four co-axially mounted polar plates have the same projected area and are matched with the three Nd—Fe—B magnets. The contents concerning the structures and installations of the bracket 681 made of aluminium alloy, the annular magnetic yoke . . . and the frame 601, the frame 601, the elastic damping plate 641, the vibrating membrane 606 and the dangling edge 699, and the symmetrical magnetic path with symmetrical magnetic gaps formed by the outer polar surfaces of the polar plates 603A, 603D with the two end surfaces of the annular magnetic yoke refer to those descriptions to Embodiment 1 of FIG. 1 and Embodiment 4 of FIG. 5 and thus they will not be repeated herein.

The inner circumferential surface of the annular magnetic yoke 613 forms, together with the vertical circumferential surfaces of the four polar plates, four annular, co-axial magnetic gaps in the same diameter, into which the coil bobbin 607 with four co-axially coils installed thereto is inserted, wherein the coils each are wounded by one layer of electromagnetic wires.

When the outside two coils 609A and 609D have a clockwise winding direction and a counter-clockwise winding direction respectively, as viewed from the outside of the vibrating membrane, the intermediate two coils 609B and 609C must have a counter-clockwise winding direction and a clockwise winding direction, correspondingly, and vice versa. The tail YA of the coil 609A is in serial connected with the head XB of the coil 609B, the tail YB of the coil 609B is in serial connected with the head XC of the coil 609C, the tail YC of the coil 609C is in serial connected with the head XD of the coil 609D, and the tail YD of the coil 609D is guided upwardly, vertically along the coil bobbin 607 to form, together with the head XA of the coil 609A, a pair of signal input terminals of the transducer. It is set that the coils 609A and 609D, as well as the coils 609B and 609C, of the four coils, are identical to each other in the cross-sectional area of electromagnetic lines, the number of turns, the winding extent, the resistance, the absolute value of inductance and the tensile force during winding, respectively. Therefore, two groups of vertically symmetrical coil circuits are formed with the halving line X-X axis at the half axial height of the intermediate permanent magnet 602B as the horizontal symmetrical axis. The inductances of the four coils and the back electromotive forces induced from their reciprocating movements are cancelled out, as they have a difference in phase angle of 180 degrees. The transducer is an inner magnetic transducer with four magnetic gaps and four coils which has resistance load characteristics or approximately resistance load characteristics and has high sensitivity, high analytic capability and high fidelity.

It should be specially noticed that, according to the above principle as regulated in Embodiment 5, corresponding polar plates, permanent magnets and coils may be added to thereby produce an inner magnetic transducer with 5 to 10 magnetic gaps and 5 to 10 coils. In this case, all the clockwise wound coils and the counter-clockwise wound coils can be connected in parallel to two copper foil which are adhered to the coil bobbin. Also, as set forth in the technical solution of CN2437092Y of the present inventor, the influence from the parallel inductance of five or more coils upon the high-frequency section and the back electromotive force of the transducer is so little that it can be ignored.

Figure 7:
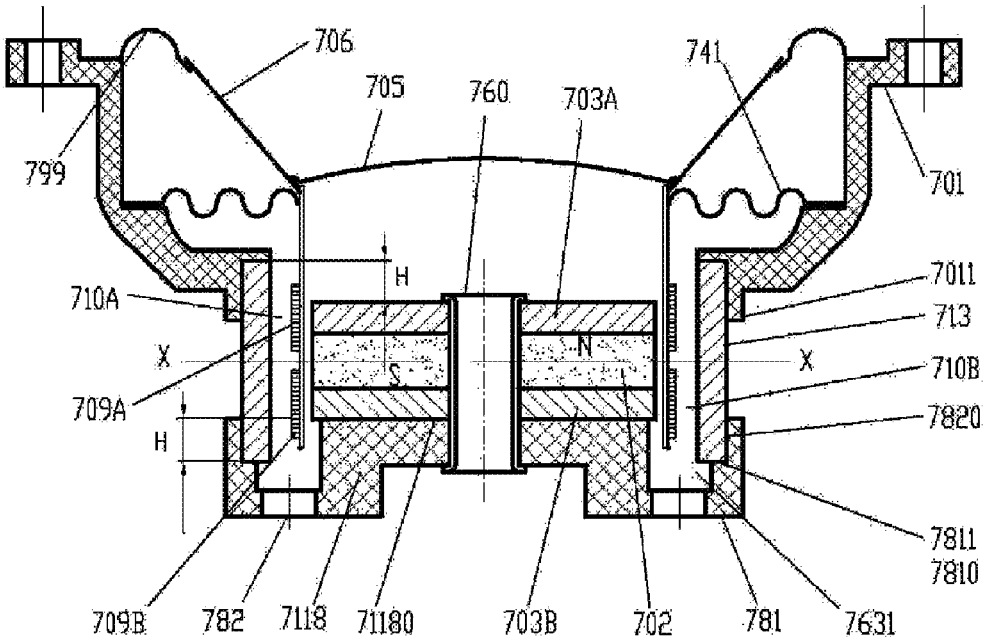
FIG. 7 is a longitudinal section view of Embodiment 6 according to the present invention.

FIG. 7 is a longitudinal section view of Embodiment 6 according to the present invention. It is an embodiment of an inner magnetic speaker with double magnetic gaps and double coils. The differences between Embodiment 6 of FIG. 7 and those of FIGS. 1, 3 and 4 are as follows: the upper polar plate 703A, the lower polar plate 703B, the Nd—Fe—B magnet 702 and the inwardly convex circular platform 7118 of the bracket 781 of aluminium alloy are provided with central axial holes. The elements 703A, 702 and 703B are co-axially adhesively fixed, with a fastener 760 of non-magnetic material, such as a seamless stainless steel tubular section consisting of 1Cr18Ni9Ti constituent, being inserted into the four axial holes. At the same time, the length of the fastener is selected in such a way that each of the two ends of the stainless steel tubular fastener is expanded and riveted by a specific tool to exhibit an out-turned horn-mouth-like shape, and the two ends are closely pressed onto the upper polar plate 703A, the permanent magnet 702, the lower polar plate 703B and the element 7118 such that they are integrally joined as a whole.

Since the element 760 is a hollow stainless steel tubular section in the present embodiment, it is able to provide a good ventilating and heat-dissipating passage for the transducer and thus is available for a professional speaker with a large caliber or a high-powered mechanical-electrical transducer.

Without question, in order to achieve the same purpose, it is also possible to form OD threads on the outer surface(s) of the end(s) of a stainless steel tubular section in a proper length, and the elements 703A, 702 and 703B are firmly fixed on the axial center of the element 7118 by means of a nut and gasket of non-magnetic material, and an adhesive.

Except the above difference, Embodiment 6 is fully identical to Embodiment 1 in terms of structure, working principle and describing contents. Therefore, no repeated description will be given here.

Figure 12:
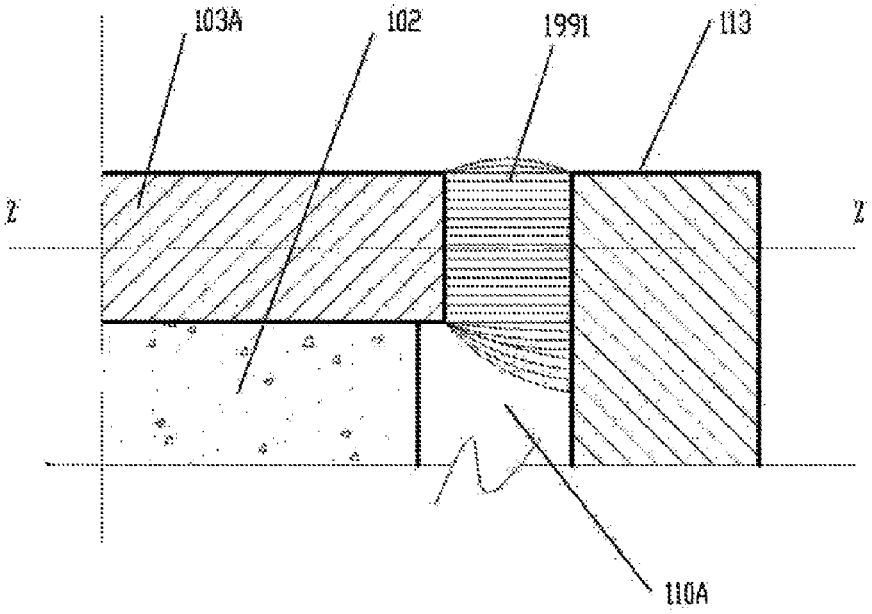
FIG. 12 is a schematic view showing the distribution of magnetic gap magnetic lines of the outer polar plate in a prior art speaker.

FIG. 12 is schematic view showing the distribution of magnetic lines in a magnetic gap of the outer polar plate in a prior art speaker. FIG. 12 is, on substance, an enlarged-view of a node of Embodiment 1 of FIG. 1 in the present invention. The element 103A is an outer polar plate of the transducer, with a horizontal halving line at the half axial height of the plate as the Z-Z axis. As can be seen from FIG. 12, in this case, the outer polar surface of the polar plate is flush with the end surface of the annular magnetic yoke, namely, the H-value indicated in FIG. 1 is zero. In the annular magnetic gap, the permanent magnetic lines 1991 at both sides of the Z-Z axis are asymmetrical. If the coil 109A shown in FIG. 1 is inserted into the magnetic gap, the horizontal halving line at the half axial height of the coil is overlapped with the Z-Z axis. When the coil is connected to an audio signal current, the distribution shape of the permanent magnetic lines at the upper portion of the Z-Z axis has a different density from that at the lower portion, with a result that the upper and lower portions of the Z-Z axis of the coil 109A will produce unequal electrodynamic forces cF, respectively, to deform the coil and thereby increase distortion of the speaker.

FIG. 13 is a schematic view showing the distribution of magnetic lines in a magnetic gap of the outer polar plate according to the present invention. In this case, the H-value which is in a close relation with the caliber of the speaker and the geometric size and the magnetic energy of the permanent magnet is equivalent to or more than 0.5 mm. As shown in FIG. 13, at both sides of the Z-Z axis, the permanent magnetic lines 1991 are in a symmetrical state all the time. The technical deficiency in the prior art as shown in FIG. 12 is necessarily rectified.

FIGS. 14A to 14D are schematic waveform diagrams of the audio signal and the back electromotive force of the two groups of symmetrical coil circuits according to the present invention. Wherein, FIG. 14A shows a waveform of a sine wave audio current signal input into the coil (for example the element 109A of FIG. 1) at one side of X-X axis of a transducer according to any of the embodiments of the present invention, and a spike pulse waveform of the back electromotive force as generated by inductance at the zero crossing point. FIG. 14B shows a waveform a sine wave audio current signal input into the coil (for example the element 109B of FIG. 1) at the other side of the X-X axis of the transducer according to any of the embodiments of the present invention, and a spike pulse waveform of the back electromotive force as generated by inductance at the zero crossing point. As shown in the two figures, the two sine wave audio current signals have a difference in phase angle of 180 degrees, pursuant to the implement principle of the present invention. FIG. 14C shows a spike pulse waveform of the back electromotive force as generated by inductance within the coil (for example the element 109A of FIG. 1) at one side of the X-X axis of the transducer according to any of the embodiments of the present invention. FIG. 14D shows a spike pulse waveform of the back electromotive force as generated by inductance within the coil (for example the element 109B of FIG. 1) at the other side of the X-X axis of the transducer according to any of the embodiments of the present invention. Due to opposite winding directions of the two coils at two sides of the Z-Z axis, the back electromotive forces as induced by the two coils in the same speaker are counteracted by each other to zero due to the 180-degree difference in phase angle.

Figure 19:
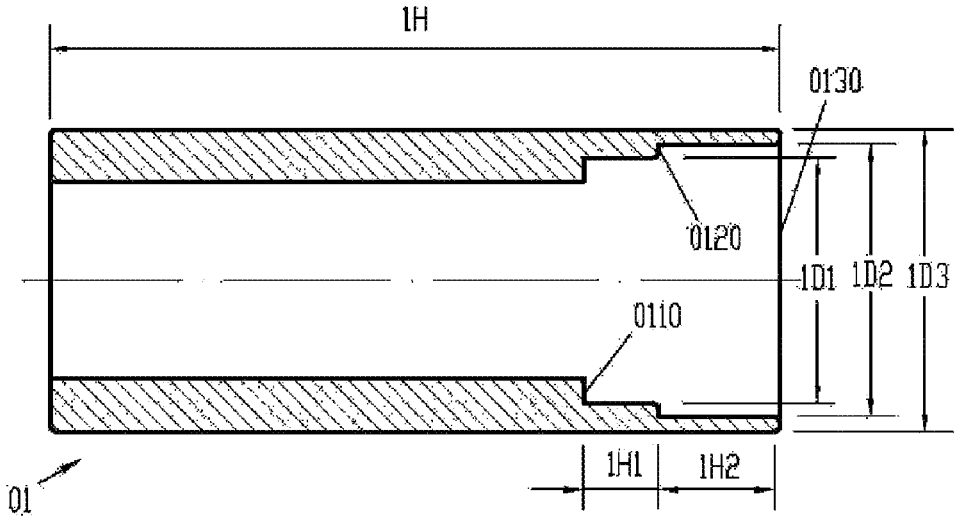
FIG. 19 is a longitudinal section view of the tubular tooling 01 according to the present invention.

FIG. 19 is a longitudinal section view of the embodiment of the tubular tooling 01 according to the present invention. The present embodiment employs a seamless stainless steel tube consisting of 1Cr18Ni9Ti constituent with non-magnetic characteristics. The total height of the tube is 1H. Its inner diameter 1D1 is 0.02-0.05 mm more than the diameter of the Nd—Fe—B magnet, and its height 1H1 is 0.1-2 mm less than the thickness of the Nd—Fe—B magnet. Its inner diameter 1D2 is 0.02-0.05 mm more than the diameter of the polar plate, and its height 1H2 is substantially identical to the thickness of the polar plate. Its inner diameter 1D3 allows the thin wall of the tubular section in the height of 1H2 to have a sufficient rigidity.

Figure 20:
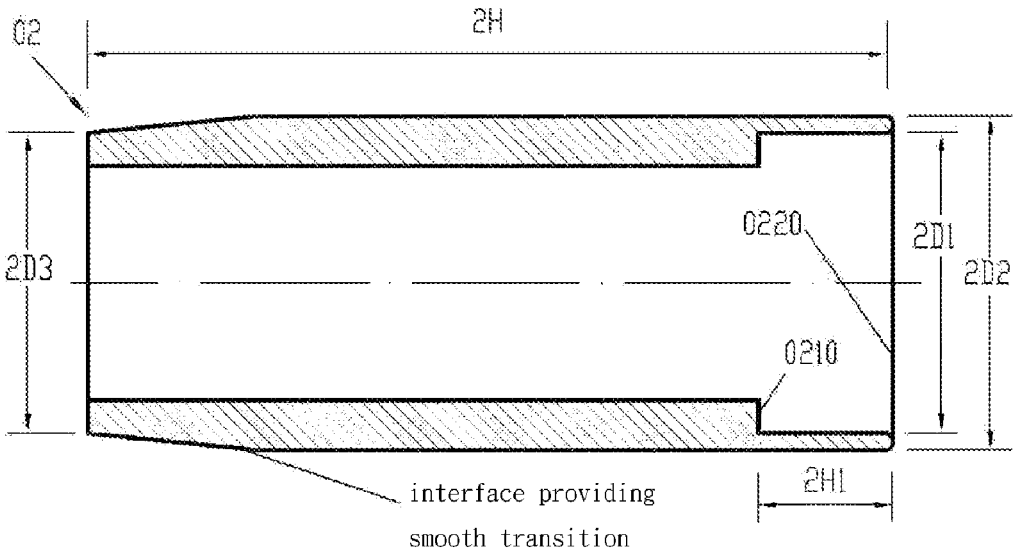
FIG. 20 is a longitudinal section view of the tubular tooling 02 according to the present invention.

FIG. 20 is a longitudinal section view of the embodiment of the tubular tooling 02 according to the present invention. The present embodiment employs a seamless stainless steel tube consisting of 1Cr18Ni9Ti constituent with non-magnetic characteristics. The total height of the tube is 2H. Its inner diameter 2D1 is 0.02-0.05 mm larger than the outer circular diameter of the polar plate or the inwardly convex circular platform, and its height 2H1 is substantially identical to or slightly less than the total thickness of the polar plate and the permanent magnets or the repellent-type magnet(s) or the repellent-type magnets of the transducer. Its outer diameter 2D2 is 0.02-0.03 mm less than the outer diameter of the annular magnetic yoke. The other end of the tubular tooling has a relatively small outer diameter 2D3 which is 1-5 mm less than the inner diameter of the annular magnetic yoke.

Figure 21:
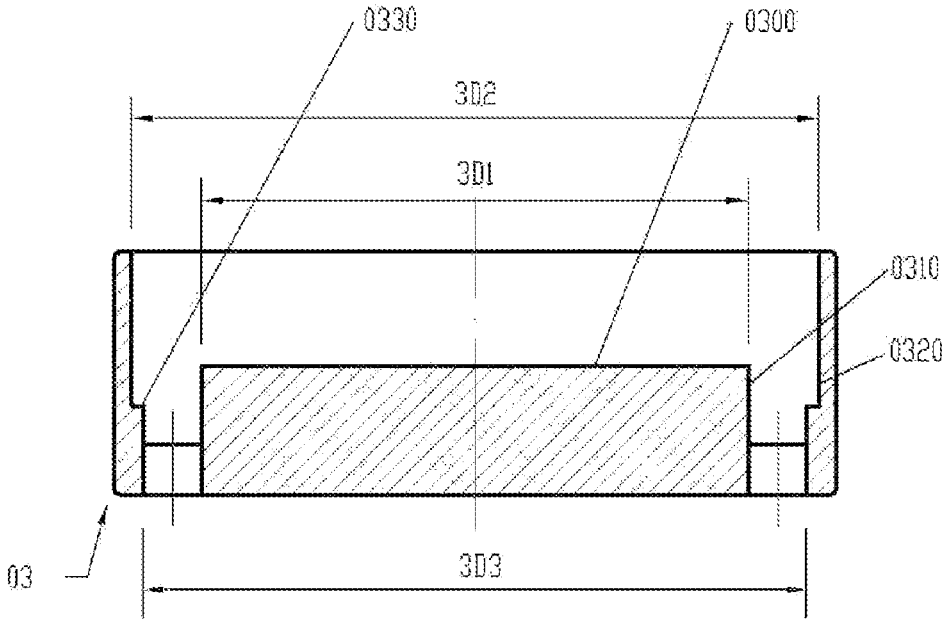
FIG. 21 a longitudinal section view showing the bracket 03 according to the present invention.
Figure 22:
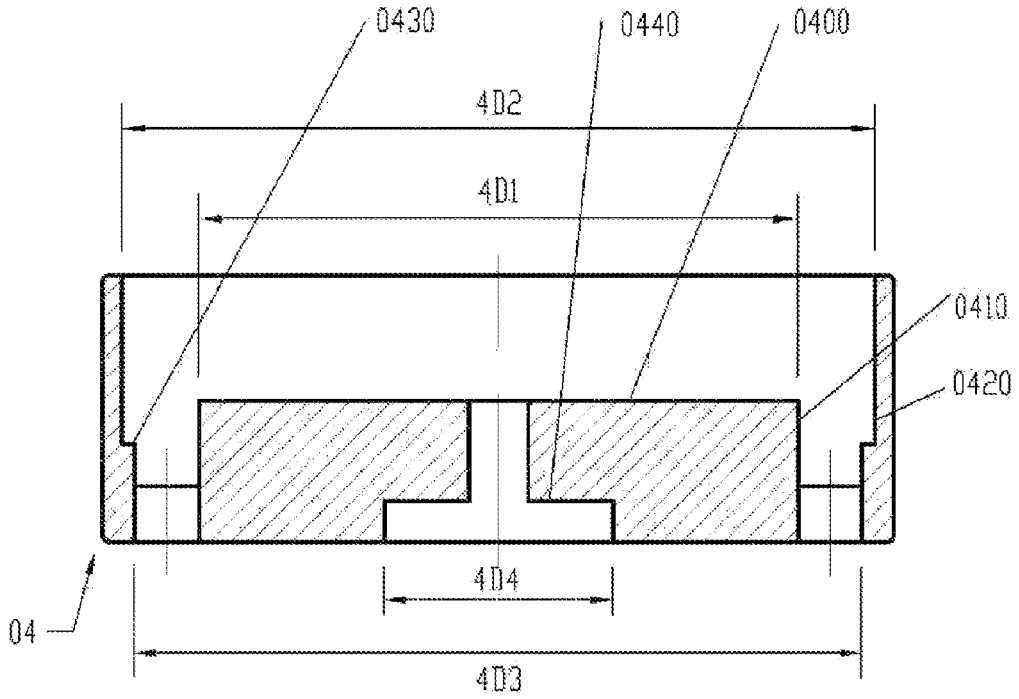
FIG. 22 is a longitudinal section view showing the bracket 03 according to the present invention.

FIG. 21 is a longitudinal section view of the embodiment of the bracket 03 according to the present invention. The bracket of the present embodiment is made of aluminium alloy. The inwardly convex circular platform in the bracket is provided with a mounting horizontal surface 0300 and a smooth and well-defined vertical outer circular surface. The diameter 3D1 of the platform is 0.02-0.03 mm less than the polar plate of the transducer. Outside the vertical outer circular surface, there is an annular groove with two or more vent holes being evenly distributed in the bottom of the groove. The outerside of the annular groove constitutes the annular thin wall of the bracket. At the top of the annular thin wall, there is a smooth and well-defined horizontal positioning surface, and at a certain axial height of the inner circumferential surface of the annular thin wall, there are a smooth and well-defined horizontal positioning surface 0330 and a vertical positioning surface 0320. The inner circular diameter 3D2 of the annular thin wall is 0.1-2 mm more than the outer diameter of the annular magnetic yoke. From FIGS. 1 to 9, the bracket is provided with corresponding reference signs 181 to 981.

Figure 8:
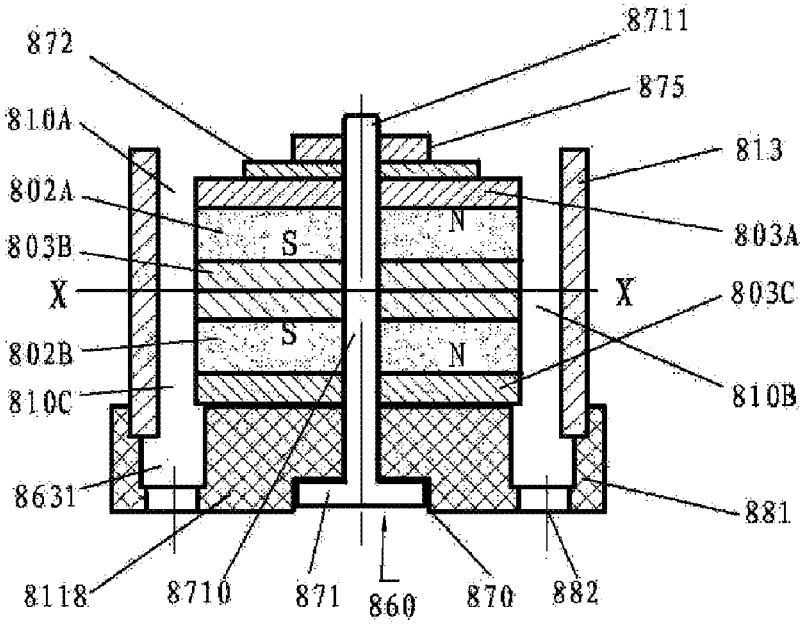
FIG. 8 is a longitudinal section view of Embodiment 7 according to the present invention.

FIG. 8 is a longitudinal section view of Embodiment 7 according to the present invention. It is an embodiment of an inner magnetic speaker with three magnetic gaps and three coils. With respect to the magnetic path and the circuit, Embodiment 7 of FIG. 8 is fully identical to Embodiment 4 of FIG. 5 in structure and working principle. Therefore, such elements as the frame, the vibrating membrane, the elastic wave, the coil, the coil bobbin and the like are omitted from FIG. 8. The differences between Embodiment 7 of FIG. 8 and Embodiment 4 of FIG. 5 are as follows: in Embodiment 7, the intermediate polar plate 803B consists of two polar plates in the same thickness and diameter as the outer polar plates 803A and 803C. As shown in FIG. 10-A, a unit of vertically symmetrical polar plates and permanent magnet is formed with the X-X horizontal axis at the half axial height of the permanent magnet 802A as the symmetrical axis, the polarity of the unit being shown in FIG. 10-A. Two such units are adhered and magnetized, and the polar surfaces of the S-pole polar plates of the two units are adhered together. Hence, a speaker with three magnetic gaps and three coils is formed with the two units constituting the repellent-type magnets, as shown in FIG. 8. For some high-powered transducer with a very strong magnetic force, or for the purpose of further simplifying the mounting and magnetizing processes, the polar plates, the magnets and the inwardly convex platform, as shown in FIG. 8, are provided with central axial holes 8700 of the same diameter. A fastener of non-magnetic material, for instance a screw 8710 consisting of 1Cr18Ni9Ti constituent, passes through the central axial holes. A nut 871 is embedded into the notch 870 in the bottom of the inwardly convex circular platform of the bracket. By means of the pressing force applied by the non-magnetic gasket and nut, the S-pole surfaces of two units of pre-magnetized polar plates and magnetic magnet, as well as the unit and the inwardly convex platform surface of the bracket can be very firmly adhered to be integrated as a whole.

FIG. 9 is a longitudinal section view of Embodiment 8 according to the present invention. It is an embodiment of an inner magnetic speaker with four magnetic gaps and four coils. Similarly, by means of a fastener 960 of non-magnetic material, the three units of magnetized polar plates and permanent magnet are pressed together to be firmly while conveniently adhered to the inwardly convex platform of the aluminium-alloy bracket.

FIG. 10-B is a further embodiment of Embodiment 9 according to the present invention. The polar plates and the permanent magnet do not have central axial holes. The polar plates 303A and 303B at the two sides of the permanent magnet 302A, which take the X-X horizontal axis at the half axial height of the permanent magnet 302A as the symmetrical axis, constitute a unit of vertically symmetrical polar plates and permanent magnet, with its polarity as shown in FIG. 10-B. Similarly, it is possible to use two such units in the speaker with three magnetic gaps and three coils in FIG. 5, or the speaker with four magnetic gaps and four coils in FIG. 6, the polar plates, the permanent magnets and the inwardly convex platform of the bracket are directly adhered together as a whole without the aid of the non-magnetic fastener.

Figure 11:
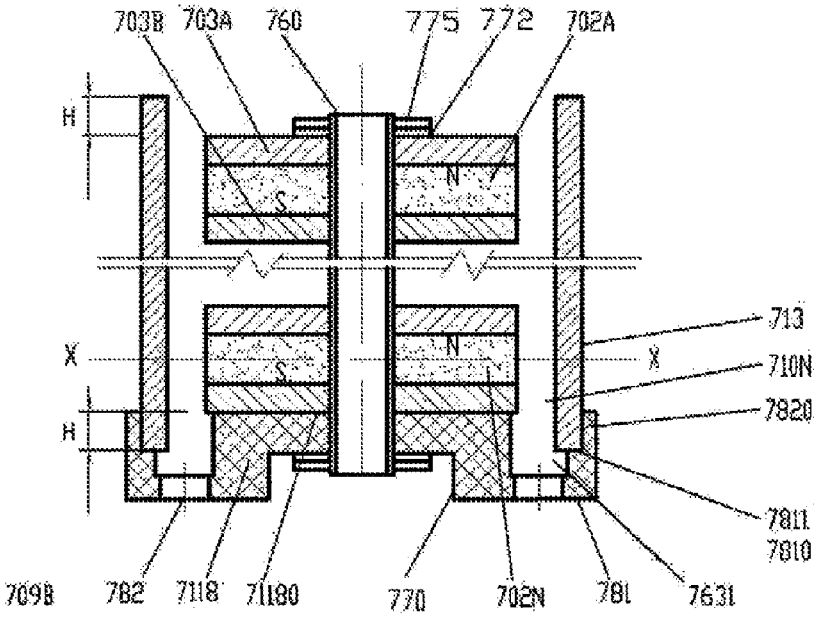
FIG. 11 is a longitudinal section view of Embodiment 10 according to the present invention.

FIG. 11 is a longitudinal section view of Embodiment 10 according to the present invention. It is an embodiment of a speaker with multiple magnetic gaps and multiple coils, for example five or more, in which a plurality of units of polar plates and permanent magnet as shown in FIG. 10-A are used, and in which the polar plates, the permanent magnets and the inwardly convex platform of the bracket are adhered and joined together as a whole by means of a non-magnetic fastener 760. In order to help ventilating and heat-dissipating of the speaker, the element 760 is a stainless steel tube consisting of 1Cr18Ni9Ti constituent, with both ends thereof having threads. By means of a non-magnetic nut and gasket, a pressing force is applied to the polar plates, the permanent magnets and the stainless steel bracket 781 so as to adhere them together as a whole more firmly and conveniently. Without question, all the coils in the present embodiment can be joined in a parallel manner by use of two bar-like copper foils which are vertically, upwardly guided along the coil bobbin.

In order to set forth the relevant issues about the back electromotive force of the speaker, FIG. 23, which is a schematic view showing the working principle of the audio current and the back electromotive force of a prior art speaker with a single magnetic gap and a single coil, is presented. The element 1 is an audio signal source, the element 2 is a traditional speaker with a single magnetic gap and a single coil, the element 2' is an equivalent electric generator potential (i.e. a back electromotive force) signal source of the speaker with a single magnetic gap and a single coil, and the element 3 is an equivalent load when the speaker runs in the state of an electric generator. As shown in the lower portion of FIG. 23, when the speaker with a single magnetic gap and a single coil is connected to the audio signal source, an instantaneous audio current I flows through the speaker, and the speaker generates an electrodynamic force F correspondingly, the directions of the current I and the force F being shown in FIG. 23. In this case, as can be seen from the upper portion of FIG. 23, when the coil of the speaker with a single magnetic gap and a single coil reciprocates like a piston under the action of the electrodynamic force F and vertically cuts the permanent magnetic lines in the magnetic gap to become an electric generator 2', with the element 3 being its equivalent load. The electric generator potential (i.e. the back electromotive force), of which the flow direction is shown by the arrow E, has a difference in phase angle of 180 degrees with respect to the audio current in the coil (ignoring the influences from the stray capacitance and inductance). Subsequently, the audio signal is distorted after they are superposed.

FIG. 24 is a schematic view showing the working principle of the audio current and the back electromotive force of a speaker with multiple symmetrical magnetic gaps and multiple symmetric coils according to the present invention. As can be seen from the lower portion of FIG. 24, when the speaker is connected to an audio signal 21, an instantaneous audio current I flows through two symmetrical coils 23A and 23B of the speaker which are wound in opposite directions, and two corresponding electrodynamic forces FA and FB are generated by the two symmetrical coils. As the two forces have the same direction, they form a resultant force F. As shown in the upper portion of FIG. 24, the two symmetrical coils of the speaker with multiple magnetic gaps and multiple coils reciprocate like a piston under the action of the electrodynamic force F and vertically cut the permanent magnetic lines in the magnetic gaps to become two equivalent electric generators 23A' and 23B'. As the two coils have opposite winding directions and the characteristics of the symmetrical magnetic paths and the symmetrical coil circuits, the absolute values of the electric generator potentials of the two coils are equivalent to each other with a difference in phase angle of 180 degrees. Hence, the back electromotive forces EA and EB are counteracted or almost counteracted by each other, when they pass through the equivalent load 24.

A preparation method for an inner magnetic transducer with multiple magnetic gaps and multiple coils:

a). a tubular tooling 01 which is made of non-magnetic material, with one end having an inner diameter 1D1 and a height 1H1, and a coaxial inner diameter 1D2 and a height 1H2, the inner diameter 1D1 being 0.01-0.5 mm less than the inner diameter 1D2, the height 1H1 being 0.1-2 mm less than the thickness of the permanent magnet, and the height 1H2 being identical to the thickness of the polar plate, the tubular sections 1H1 and 1H2 having smooth and well-defined inner circular surfaces and horizontal positioning surfaces 0110, 0120 and 0130 which orthogonally intersect the central axis of the tubular tooling 01;

b). embedding one of the permanent magnets of the transducer into the tubular section having the inner diameter 1D1 of the tubular tooling 01 to be stopped by the horizontal positioning surface 0110, the inner diameter 1D1 having a fit tolerance of positive 0.02-0.05 mm with respect to the diameter of the permanent magnet, and embedding one of the polar plates of the transducer into the tubular section having the inner diameter 1D2, the inner diameter 1D2 having a fit tolerance of positive 0.02-0.05 mm with respect to the diameter of the polar plate, and coating the coinciding polar surface of one of the permanent magnet and the polar plate with an adhesive and meanwhile applying a pressing force thereonto, and removing the tubular tooling 01 once the adhesive is cured, so as to attain a permanent magnet and a polar plate which are co-axially adhesively fixed;

c). a tubular tooling 02 which is made of non-magnetic material, with one end having a thin-walled tubular section with an inner diameter 2D1 and a height 2H1, the inner diameter 2D1 having a fit tolerance of positive 0.01-0.05 mm with respect to the outer circular diameter of the polar plate and the inwardly convex circular platform of the bracket, the tubular section 2H1 being identical to or slightly less than the total thickness of the polar plate and the permanent magnet(s) or the repellent-type magnet(s) or the repellent-type magnets of the transducer and having smooth and well-defined inner and outer circular surfaces, the tubular tooling 02 having horizontal positioning surfaces 0210 and 0220 which orthogonally intersect the central axis of the tubular tooling;

d). embedding the permanent magnet and the polar plate which are co-axially adhesively fixed into the tubular section having the inner diameter 2D1 and arranging one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface 0210 of the tubular tooling 02, removing the tubular tooling 02 once the adhesive is cured, to thereby attain two polar plates and a permanent magnet sandwiched therebetween which are co-axially adhesively fixed together;

e). magnetizing the permanent magnet and the polar plates which are co-axially adhesively fixed or only the permanent magnet by a proper magnetizing machine, and then alternately using the tubular toolings 01 and 02 so as to attain repellent-type magnets with 3-4 polar plates and 2-3 permanent magnets which are co-axially adhesively fixed together;

f). a bracket 03 which is made of non-magnetic material, with an inwardly convex circular platform at its axial center, the outer diameter 3D1 of the circular platform being less, in a negative tolerance of 0.01-0.05 mm, than the diameter of the polar plate, and having a fit tolerance of negative 0.01-0.05 mm with respect to the inner diameter 2D1 of the tubular tooling 02, at a corresponding axial height of the annular thin wall of the bracket, there being further provided a smooth and well-defined horizontal positioning surface 0330, the inner circular diameter 3D2 of the annular thin wall having a fit tolerance of positive 0.1-2 mm with respect to the outer diameter 3D2 of the annular magnetic yoke, applying an adhesive onto the inwardly convex circular platform 0300, and then placing on the adhesive the polar plates and the permanent magnets or the repellent-type magnets which have already been co-axially adhesively fixed and magnetized, and then embedding them into the inner wall of the tubular tooling 02, the inner wall of the tubular tooling 02 being smoothly fit and secured with the vertical outer circular surface 0310 of the inwardly convex circular platform, the horizontal positioning surface 0210 closely abutting against the outer polar surface of the polar plate and applying a pressing force, and once the adhesive is cured, the polar plates and the permanent magnets, or the repellent-type magnets are adhesively secured, at the axial center of the circular platform surface 0300 of the bracket;

g). pre-coating the adhesive onto the horizontal positioning surface 0330 or the vertical positioning surface 0320 of the bracket, and then nesting the annular magnet yoke of the transducer from outer end 2D3 of the tubular tooling 02 and inwardly sliding the annular magnet yoke along the smooth outer circular surface of the tubular section, when the annular magnet yoke reaches the polarized area of the permanent magnet, manually controlling the sliding speed of the annular magnetic yoke to finally stop it by the horizontal positioning surface 0330 of the bracket, removing the tubular tooling 02 once the adhesive is cured, so as to prepare two or more groups of symmetrical magnetic paths and two or more co-axial annular magnetic gaps of the same diameter;

h). embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin and two or more coils into the annular magnetic gaps, adhering in turns within the frame, one or two elastic damping plates, the coil bobbin, the vibrating membrane or the planar sound generating plate, to thereby prepare an inner magnetic transducer with multiple magnetic gaps and multiple coils which has resistance load characteristics or approximately resistance load characteristics and has high sensitivity, high analytic capability and high fidelity.

A preparation method for an inner magnetic transducer with multiple magnetic gaps and multiple coils:

a). the polar plates and the permanent magnet(s) of the transducer with multiple magnetic gaps and multiple coils are provided with central axial holes of the same diameter at the respective axial centers thereof;

b). a tubular tooling 01 which is made of non-magnetic material, with one end having an inner diameter 1D1 and a height 1H1, and a coaxial inner diameter 1D2 and a height 1H2, the inner diameter 1D1 being 0.01-0.5 mm less than the inner diameter 1D2, the height 1H1 being 0.1-2 mm less than the thickness of the permanent magnet, and the height 1H2 being identical to the thickness of the polar plate, the tubular sections 1H1 and 1H2 having smooth and well-defined inner circular surfaces and horizontal positioning surfaces 0110, 0120 and 0130 which orthogonally intersect the central axis of the tubular tooling 01;

c). embedding one of the permanent magnets of the transducer into the tubular section having the inner diameter 1D1 of the tubular tooling 01 to be stopped by the horizontal positioning surface 0110, the inner diameter 1D1 having a fit tolerance of positive 0.02-0.05 mm with respect to the diameter of the permanent magnet, and then embedding one of the polar plates of the transducer into the tubular section having the inner diameter 1D2, the inner diameter 1D2 having a fit tolerance of positive 0.02-0.05 mm with respect to diameter of the polar plate, and then coating the coinciding polar surface of one of the permanent magnet and the polar plate with an adhesive and meanwhile applying a pressing force thereonto, and then removing the tubular tooling 01 once the adhesive is cured, so as to attain a permanent magnet and a polar plate which are co-axially adhesively fixed and which have central axial holes;

d). a tubular tooling 02 which is made of non-magnetic material, with one end having a thin-walled tubular section with an inner diameter 2D1 and a height 2H1, the inner diameter 2D1 having a fit tolerance of positive 0.01-0.05 mm with respect to the outer circular diameter of the polar plate and the inwardly convex circular platform of the bracket, the tubular section 2H1 being identical to or slightly less than the total thickness of the polar plate and the permanent magnets or the repellent-type magnet(s) or the repellent-type magnet (s) of the transducer and having smooth and well-defined inner and outer circular surfaces, the tubular tooling 02 having horizontal positioning surfaces 0210 and 0220 which orthogonally intersect the central axis of the tubular tooling;

e). embedding the permanent magnet and the polar plate which are co-axially adhesively fixed into the tubular section having the inner diameter 2D1 and arranging one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface 0210 of the tubular tooling 02, removing the tubular tooling 02 once the adhesive is cured, to thereby attain two polar plates and a permanent magnet sandwiched therebetween which are co-axially adhesively fixed together and which have axial holes;

f). Magnetizing the permanent magnet and the polar plates which are co-axially adhesively fixed or magnetizing only the permanent magnet by a proper magnetizing machine, and then alternately using the tubular toolings 01 and 02 so as to attain repellent-type magnets with 3-4 polar plates and 2-3 permanent magnets which are co-axially adhesively fixed together;

g). a bracket 04 which is made of non-magnetic material, with an inwardly convex circular platform at its axial center, the axis of the circular platform being provided with a central axial hole which is matched with the axial holes of the pole plates and the permanent magnet and an associated quadrangular or hexagonal concave hole, the outer diameter 4D1 of the circular platform being less, in a negative tolerance of 0.01-0.05 mm, than the diameter of the polar plate, and having a fit tolerance of negative 0.01-0.05 mm with respect to the inner diameter 2D1 of the tubular tooling 02, at a corresponding axial height of the annular thin wall of the bracket, there being a smooth and well-defined horizontal positioning surface 0430, the inner circular diameter 4D2 of the annular thin wall having a positive tolerance of 0.1-2 mm with respect to the outer diameter of the annular magnetic yoke, applying the adhesive onto the inwardly convex circular platform 0400, and then placing on the adhesive the polar plates and the permanent magnet(s) or the repellent-type magnets which have already been co-axially adhesively fixed and magnetized, and embedding them into the inner wall of the tubular tooling 02, the inner wall of the tubular tooling 02 being smoothly fit and secured with the vertical outer circular surface 0410 of the inwardly convex circular platform, and meanwhile inserting a non-magnetic material fastener into the central axial holes of the polar plates, the permanent magnets, and the bracket, the horizontal positioning surface 0210 of the tubular tooling 02 closely abutting against the outer polar surface of the polar plate and applying a pressing force, and once the adhesive is cured, the polar plates and the permanent magnet(s) or the repellent-type magnets are adhesively secured to the axial center of the circular platform surface 0400 of the bracket;

h). pre-coating the adhesive onto the horizontal positioning surface 0430 or the vertical positioning surface 0320 of the bracket, and then nesting the annular magnet yoke of the transducer from outer end 2D3 of the tubular tooling 02 and inwardly sliding the annular magnet yoke along the smooth outer circular surface of the tubular section, when the annular magnet yoke reaches the polarized area of the permanent magnet, manually controlling the sliding speed of the annular magnetic yoke to finally limit it by the horizontal positioning surface 0430 of the bracket, removing the tubular tooling 02 once the adhesive is cured, so as to prepare two groups or more groups of symmetrical magnetic paths and two or more co-axial annular magnetic gaps of the same diameter;

i). Embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin with two or more coils into the annular magnetic gaps, adhering in turns within the frame, one or two elastic damping plates, the coil bobbin, the vibrating membrane or the planar sound generating plate, to thereby prepare an inner magnetic transducer with multiple magnetic gaps and multiple coils which has resistance load characteristics or approximately resistance load characteristics and has high sensitivity, high analytic capability and high fidelity.

It should be noted that, by use of all the structural forms of magnetic paths, different combinations of polar plates and permanent magnet(s) and different transducer coil circuit connecting manners, as shown in FIG. 1-FIG. 22 according to the present invention, inner magnetic transducers with multiple gaps and multiple coils of various types can be formed via permutation and combination. Although it is impossible for the present invention to list all the embodiments one by one, it should be known that, no matter what kind of this and other local modifications are done to the above technical features of the present invention, their entire technical solutions and key inventive contents will not go beyond the entire covering range of the claims and description of the present invention.

The present invention has the following beneficial effects:

1. The back electromotive force can be eliminated without the need of adding any other electronic element or control circuit.

2. Various speakers and electroacoustic sensors, which have resistance load characteristics or approximately resistance load characteristics thereto and have high cost performance, high sensitivity, high analytic capability and high fidelity, can be in mass production.

3. A wide covering extent of the patent technology: it can be applied to all the electroacoustic transducers, sensors and mechanical-electrical transducers except mobile-phones.

4. It is possible to produce a full-range speaker, with less than 7-inch caliber, only one tapered vibrating membrane or inwardly convex vibrating membrane, a frequency responding range of FO—20 KHz, and an excellent electroacoustic restoration effect from only about 1 W of continuous input power.

5. A green environmental-protection product with high energy efficiency.

What is claimed is:

1. An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the magnetic path comprises a upper polar plate and a lower polar plate which are co-axially mounted, one axially-magnetized permanent magnet or more than one axially-magnetized permanent magnets of the same thickness is sandwiched between the upper polar plate and the lower polar plate, the two polar plates have the same projected area and match with the permanent magnet, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner circumferential surface or the outer circumferential surface of the annular thin wall, a smooth and well-defined vertical positioning surface is further arranged, the upper and lower polar plate, and the permanent magnet is adhesively fixed onto the axial center of the circular platform surface of the bracket, an annular magnetic yoke being co-axially mounted with the upper and lower polar plates and the permanent magnet, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, two co-axial annular magnetic gaps of the same diameter are formed between the inner circumferential surface of the annular magnetic yoke and the vertical circumferential surfaces of the upper and lower polar plates;

two of said coils, which are co-axially mounted, are inserted into the annular magnetic gaps, said coils are formed by winding one or two layers of electromagnetic wires, a corresponding space is arranged between the two coils, and the winding directions of the two coils and the directions of current flowing through the two coils are set such that the two coils generate electrodynamic forces F of the same direction at the same working instant;

the transducer has two groups of magnetic paths which are vertically and horizontally symmetrical in terms of geometrical shape and magnetic performance, with the central axis of the upper and lower plates and the permanent magnet as the vertical symmetrical axis, and with the halving line X-X axis at the half axial height of the permanent magnet as the horizontal symmetrical axis;

the two coils are set identical to each other in terms of the cross-sectional area of electromagnetic wires, the number of turns, the winding extent, the resistance, the absolute value of inductance and the tensile force during winding and thus form two groups of vertically symmetrical coil circuits by taking the halving line X-X axis at the half axial height of the permanent magnet as the horizontal symmetrical axis, the inductances of the two coils and the back electromotive forces induced in course of their reciprocating movements are cancelled out due to a difference in phase angle of 180 degrees, and hence the transducer is an inner magnetic transducer with multiple magnetic gaps and multiple coils which has resistance load characteristics or approximately resistance load characteristics and has high sensitivity, high analytic capability and high fidelity.

2. An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the magnetic path comprises a upper polar plate and a lower polar plate which are co-axially mounted and which are provided with central axial holes, an axially-magnetized ring-shaped permanent magnet or more than one sector-like or disc-like permanent magnets of the same thickness is sandwiched between the upper polar plate and the lower polar plate, the two polar plates have the same projected area and match with the permanent magnet, a bracket is made of non-magnetic material and provided with an inwardly convex circular platform at the axial center thereof, the axial center of the circular platform is provided with an axial hole, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner circumferential surface or the outer circumferential surface of the annular thin wall, a smooth and well-defined vertical positioning surface is further arranged, a fastener, which is made of non-magnetic material penetrates through the circular axial holes of the upper and lower polar plates, the permanent magnet and the bracket, and jointly fixes them on the axial center of the circular platform surface of the bracket, an annular magnetic yoke being co-axially mounted with the upper and lower polar plates and the permanent magnet, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, two co-axial annular magnetic gaps of the same diameter are formed between the inner circumferential surface of the annular magnetic yoke and the vertical circumferential surfaces of the upper and lower polar plates;

two of said coils, which are co-axially mounted, are inserted into the annular magnetic gaps, said coils are formed by winding one or two layers of electromagnetic wires, a corresponding space is arranged between the two coils, and the winding directions of the two coils and the directions of current flowing through the two coils are set such that the two coils generate electrodynamic forces F of the same direction at the same working instant;

the transducer has two groups of magnetic paths which are vertically and horizontally symmetrical in terms of geometrical shape and magnetic performance, with the central axis of the upper and lower plates and the permanent magnet as the vertical symmetrical axis, and with the halving line X-X axis at the half axial height of the permanent magnet as the horizontal symmetrical axis;

the two coils are set identical to each other in terms of the cross-sectional area of electromagnetic wires, the number of turns, the winding extent, the resistance, the absolute value of inductance and the tensile force during winding and thus form two groups of vertically symmetrical coil circuits by taking the halving line X-X axis at the half axial height of the permanent magnet as the horizontal symmetrical axis, the inductances of the two coils and the back electromotive forces induced in course of their reciprocating movements are cancelled out due to a difference in phase angle of 180 degrees, and hence the transducer is an inner magnetic transducer with multiple magnetic gaps and multiple coils which has resistance load characteristics or approximately resistance load characteristics and has high sensitivity, high analytic capability and high fidelity.

3. An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted on respective outer surfaces of the two permanent magnets to constitute a pair of repellent-type magnets, the three polar plates, which are co-axially mounted, have the same projected area and match with the two permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, three co-axial annular magnetic gaps of the same diameter;

three of said coils, which are co-axially mounted, are inserted into the annular magnetic gaps, said coils are formed by winding one or two layers of electromagnetic wires, corresponding spaces are arranged between the three coils, and the winding directions of the three coils and the directions of current flowing through the three coils are set such that the three coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate polar plate of the repellent-type magnets as the horizontal symmetrical axis;

when the two outer coils (309A) and (309C) have a clockwise winding direction as viewed from the outerside direction of the vibrating membrane, the intermediate coil (309B) must have a counter-clockwise winding direction, and vice versa, the tail YA of the coil (309A) is serially connected with the head XB of the coil (309B), the tail YB of the coil (309B) is serially connected with the head XC of the coil (309C), the tail YC of the coil (309C) is upwardly and vertically guided along the coil bobbin (307) to form, together with the head XA of the coil (309A), a pair of signal input terminals of the transducer, the three coils (309A, 309B and 309C) are set to have the same cross-sectional area of the electromagnetic wires and tensile force during winding, the coils (309A and 309C) are set to have the same number of turns, winding extent, resistance and absolute value of inductance, and the number of turns, winding extent, resistance and absolute value of coil inductance of the coil (309B) are set to be identical to the corresponding sums of the numbers of turns, winding extents, resistances, absolute values of inductance of the two coils (309A, 309C), so as to form two groups of vertically symmetric coil circuits with the halving line X-X axis at the half axial height of the intermediate plate as the horizontal symmetrical axis, the inductances of the three coils and the back electromotive forces induced by their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

4. An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted on respective outer surfaces of the two permanent magnets to constitute a pair of repellent-type magnets, the three polar plates, which are co-axially mounted, have the same projected area and match with the two permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, three co-axial annular magnetic gaps of the same diameter;

three of said coils, which are co-axially mounted, are inserted into the annular magnetic gaps, said coils are formed by winding one or two layers of electromagnetic wires, corresponding spaces are arranged between the three coils, and the winding directions of the three coils and the directions of current flowing through the three coils are set such that the three coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate polar plate of the repellent-type magnets as the horizontal symmetrical axis;

when the two outer coils (309A' and 309C') have a clockwise winding direction as viewed from the outerside direction of the vibrating membrane, the intermediate coil (309B') must have a counter-clockwise winding direction, and vice versa, a central tap YB' is disposed at the a half number of turns of the coil (309B') to constitute two equally-divided coils (309B1' and 309B2'), the tail YA' of the coil (309A') is serially connected with the head XB1' of the coil (309B1'), the head XC' of the coil (309C') is serially connected with the tail YB2' of the coil (309B2'), the tail YC' of the coil (309C') is in parallel connected with the head XA' of the coil (309A') and then is upwardly and vertically guided, together with the central tap terminal YB' of the coil (309B) along the coil bobbin to form a pair of signal input terminals of the transducer, the coil (309A') and the coil (309B1'), as well as the coil (309C') and the coil (309B2'), are identical to each other in terms of the cross-sectional area of the electromagnetic wires, the number of turns, the winding extent, the resistance, the absolute value of inductance and the tensile force during winding so as to form two groups of vertically symmetrical coil circuits with the halving line X-X axis at the half axial height of the intermediate polar plate as the horizontal symmetrical axis, the inductances of the four coils and the back electromotive forces induced from their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

5. An inner magnetic transducer with multiple magnetic gaps and multiple coils, which comprises: a magnetic path and a frame being connected therewith, at least two co-axial annular magnetic gaps and a coil bobbin being inserted into the annular magnetic gaps on which mutually-insulating electromagnetic wires are wound in parallel to form at least two coils, a vibrating membrane or a planar sound generating plate being connected with the coil bobbin and an elastic damping plate, the vibrating membrane or the planar sound generating plate is driven to vibrate in air to generate sound by reciprocating the coil bobbin, or the change in the sound pressure is detected via the vibrating membrane and a sound voltage signal is induced in the coils, the transducer being characterized in that, the frame is made of non-magnetic material and provided with at least two circular axial holes at the axial center thereof, the frame is provided with, at different axial heights, one or two annular platform surfaces for mounting elastic damping plates, two opposite surfaces of one polar plate in the magnetic path are provided with one axially magnetized permanent magnet, respectively, and the permanent magnets have the same polarity at their sides abutting against the polar plate, polar plates are further mounted onto respective outer surfaces of the two permanent magnets to constitute two or more pairs of repellent-type magnets, the four or more polar plates, which are co-axially mounted, have the same projected area and match with the three or more permanent magnets, a bracket is made of non-magnetic material and provided with an inwardly convex circular platform at the axial center thereof, the circular platform has a smooth and well-defined vertical outer circular surface, an annular groove is arranged on the outside of the vertical outer circular surface and is provided with two or more vent holes evenly distributed in the bottom thereof, the outerside of the annular groove constitutes the annular thin wall of the bracket, at a corresponding axial height or at the top end of the inner circumferential surface of the annular thin wall, a smooth and well-defined horizontal positioning surface is arranged, at a corresponding axial height of the inner or outer circumferential surface of the annular thin wall, a smooth and well-defined vertical positioning surface is further arranged, the repellent-type magnets are adhesively fixed onto the axial center of the circular platform surface of the bracket, an annular magnetic yoke being co-axially mounted with the repellent-type magnets, is at its one end engagely or adhesively fixed with and meanwhile stopped by the vertical positioning surface of the annular thin wall of the bracket, and at the other end embedded into the circular axial holes in the bottom of the frame and jointly or adhesively fixed with the frame, two end surfaces of the annular magnetic yoke extend beyond, in their axial heights, the outer polar surfaces of the upper and lower polar plates, respectively, by a H-value of 0.5-20 mm, and form two groups of vertically symmetrical magnetic gap magnetic paths, the inner circumferential surface of the annular magnetic yoke forms, together with the vertical circumferential surfaces of the polar plates of the repellent-type magnets, four or more co-axial annular magnetic gaps of the same diameter;

four or more of said coils, which are co-axially mounted, are inserted into the annular magnetic gaps, said coils are formed by winding one or two layers of electromagnetic wires, corresponding spaces are arranged between the four or more coils, and the winding directions of the four or more coils and the directions of current flowing through the four or more coils are set such that the four or more coils generate electrodynamic forces F of the same direction at the same working instant;

the transducer has two groups of magnetic paths which are vertically and horizontally symmetrical in terms of geometrical shape and magnetic performance, with the central axis of the repellent-type magnets as the vertical symmetrical axis, and with the halving line X-X axis at the half axial height of the intermediate permanent magnet or the intermediate polar plate of the repellent-type magnets as the horizontal symmetrical axis;

when the two outer coils (609A and 609D) have a clockwise winding direction and a counter-clockwise winding direction, respectively, as viewed from the outside of the vibrating membrane, the intermediate two coils (609B and 609C) must have a counter-clockwise winding direction and a clockwise winding direction, correspondingly, and vice versa, the tail YA of the coil (609A) is serially connected with the head XB of the coil (609B), the tail YB of the coil (609B) is serially connected with the head XC of the coil (609C), the tail YC of the coil (609C) is serially connected with the head XD of the coil (609D), and the tail YD of the coil (609D) is guided upwardly and vertically along the coil bobbin to form, together with the head XA of the coil (609A), a pair of signal input terminals of the transducer, the coils (609A and 609D), as well as the coils (609B and 609C), of the four coils, are identical to each other in terms of the cross-sectional area of electromagnetic lines, the number of turns, the winding extent, the resistance, the absolute value of inductance and the tensile force during winding so as to form two groups of vertically symmetrical coil circuits, with the halving line X-X axis at the half axial height of the intermediate permanent magnet as the horizontal symmetrical axis, the inductances of the four coils and the back electromotive forces induced from their reciprocating movements are cancelled out due to a difference in phase angle of 180 degrees, so that the transducer is an inner magnetic transducer with multiple magnetic gaps and multiple coils which has resistance load characteristics or approximately resistance load characteristics and has high sensitivity, high analytic capability and high fidelity.

6. The inner magnetic transducer with multiple magnetic gaps and multiple coils according to claim 1, characterized in that, the permanent magnet is a Nd—Fe—B magnet.

7. The inner magnetic transducer with multiple magnetic gaps and multiple coils according to claim 1, characterized in that, the bracket is made of aluminium alloy, non-magnetic stainless steel, or engineering plastic.

8. A preparation method for an inner magnetic transducer with multiple magnetic gaps and multiple coils according to claim 1, comprising:

a) a tubular tooling (01) which is made of non-magnetic material, with one end having an inner diameter (1D1) and a height (1H1), and a coaxial inner diameter (1D2) and a height (1H2), the inner diameter (1D1) being 0.01-0.5 mm less than the inner diameter (1D2), the height (1H1) being 0.1-2 mm less than the thickness of the permanent magnet, and the height (1H2) being identical to the thickness of the polar plate, the tubular sections (1H1) and (1H2) having smooth and well-defined inner circular surfaces and horizontal positioning surfaces (0110, 0120 and 0130) which orthogonally intersect the central axis of the tubular tooling (01);

b) embedding one of the permanent magnets of the transducer into the tubular section having the inner diameter (1D1) of the tubular tooling (01) to be stopped by the horizontal positioning surface (0110), the inner diameter (1D1) having a fit tolerance of positive 0.02-0.05 mm with respect to the diameter of the permanent magnet, and then embedding one of the polar plates of the transducer into the tubular section having the inner diameter (1D2), the inner diameter (1D2) having a fit tolerance of positive 0.02-0.05 mm with respect to the diameter of the polar plate, and then coating the coinciding polar surface of one of the permanent magnet and the polar plate with an adhesive and meanwhile applying a pressing force thereonto, and then removing the tubular tooling (01) once the adhesive is cured, so as to attain a permanent magnet and a polar plate which are co-axially adhesively fixed;

c) a tubular tooling (02) which is made of non-magnetic material, with one end having a thin-walled tubular section with an inner diameter (2D1) and a height (2H1), the inner diameter (2D1) having a fit tolerance of positive 0.01-0.05 mm with respect to the outer circular diameter of the polar plate and the inwardly convex circular platform of the bracket, the tubular section (2H1) being identical to or slightly less than the total thickness of the polar plate and the permanent magnet(s) or the repellent-type magnets or the repellent-type magnets of the transducer and having smooth and well-defined inner and outer circular surfaces, the tubular tooling (02) having horizontal positioning surfaces (0210 and 0220) which orthogonally intersect the central axis of the tubular tooling;

d) embedding the permanent magnet and the polar plate, which are co-axially adhesively fixed, into the tubular section having the inner diameter (2D1) and arranging one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface (0210) of the tubular tooling (02), and then removing the tubular tooling (02) once the adhesive is cured, so as to attain two polar plates and a permanent magnet sandwiched therebetween which are co-axially adhesively fixed together;

e) magnetizing the permanent magnet and the polar plates which are co-axially adhesively fixed or magnetizing only the permanent magnet by a proper magnetizing machine, and then alternately using the tubular toolings (01 and 02) so as to attain repellent-type magnets with 3-4 polar plates and 2-3 permanent magnets which are co-axially adhesively fixed together;

f) a bracket (03) which is made of non-magnetic material, with an inwardly convex circular platform at its axial center, the outer diameter (3D1) of the circular platform being less, in a negative tolerance of 0.01-0.05 mm, than the diameter of the polar plate, and having a fit tolerance of negative 0.01-0.05 mm with respect to the inner diameter (2D1) of the tubular tooling (02), at a corresponding axial height of the annular thin wall of the bracket, there being further provided a smooth and well-defined horizontal positioning surface (0330), the inner circular diameter (3D2) of the annular thin wall having a fit tolerance of positive 0.1-2 mm with respect to the outer diameter of the annular magnetic yoke, applying the adhesive onto the inwardly convex circular platform (0300) and then placing on the adhesive the polar plates and the permanent magnets or the repellent-type magnets which have already been co-axially adhesively fixed and magnetized, and then embedding them into the inner wall of the tubular tooling (02), the inner wall of the tubular tooling (02) being smoothly fit and secured with the vertical outer circular surface (0310) of the inwardly convex circular platform, the horizontal positioning surface (0210) closely abutting against the outer polar surface of the polar plate and applying a pressing force, and once the adhesive is cured, the polar plates and the permanent magnet or the repellent-type magnets are adhesively secured to the axial center of the circular platform surface (0300) of the bracket;

g) pre-coating the adhesive onto the horizontal positioning surface (0330) or the vertical positioning surface (0320) of the bracket, and then nesting the annular magnet yoke of the transducer from outer end (2D3) of the tubular tooling (02), and then inwardly sliding the annular magnet yoke along the smooth outer circular surface of the tubular section, when the annular magnet yoke reaches the polarized area of the permanent magnet, manually controlling the sliding speed of the annular magnetic yoke to finally stop it by the horizontal positioning surface (0330) of the bracket, removing the tubular tooling (02) once the adhesive is cured, so as to prepare two or more than groups of symmetrical magnetic paths and two or more co-axial annular magnetic gaps of the same diameter;

h) embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin and two or more coils into the annular magnetic gaps, and then adhering in turns within the frame, one or two elastic damping plates, the coil bobbin, the vibrating membrane or the planar sound generating plate, so as to prepare an inner magnetic transducer with multiple magnetic gaps and multiple coils which has resistance load characteristics or approximately resistance load characteristics and has high sensitivity, high analytic capability and high fidelity.

9. A preparation method for an inner magnetic transducer with multiple magnetic gaps and multiple coils according to claim 1, comprising:

a) the polar plates and the permanent magnet(s) of the transducer with multiple magnetic gaps and multiple coils are provided with central axial holes of the same diameter at the respective axial centers thereof;

b) a tubular tooling (01) which is made of non-magnetic material, with one end having an inner diameter (1D1) and a height (1H1), and a coaxial inner diameter (1D2) and a height (1H2), the inner diameter (1D1) being 0.01-0.5 mm less than the inner diameter (1D2), the height (1H1) being 0.1-2 mm less than the thickness of the permanent magnet, and the height (1H2) being identical to the thickness of the polar plate, the tubular sections (1H1) and (1H2) having smooth and well-defined inner circular surfaces and horizontal positioning surfaces (0110, 0120 and 0130) which orthogonally intersect the central axis of the tubular tooling (01);

c) embedding one of the permanent magnets of the transducer into the tubular section having the inner diameter (1D1) of the tubular tooling (01) to be stopped by the horizontal positioning surface (0110), the inner diameter (1D1) having a fit tolerance of positive 0.02-0.05 mm with respect to the diameter of the permanent magnet, and then embedding one of the polar plates of the transducer into the tubular section having the inner diameter (1D2), the inner diameter (1D2) having a fit tolerance of positive 0.02-0.05 mm with respect to diameter of the polar plate, and then coating the coinciding polar surface of one of the permanent magnet and the polar plate with an adhesive and meanwhile applying a pressing force thereonto, and then removing the tubular tooling (01) once the adhesive is cured, so as to attain a permanent magnet and a polar plate which are co-axially adhesively fixed and which have central axial holes;

d) a tubular tooling (02) which is made of non-magnetic material, with one end having a thin-walled tubular section with an inner diameter (2D1) and a height (2H1), the inner diameter (2D1) having a fit tolerance of positive 0.01-0.05 mm with respect to the outer circular diameter of the polar plate and the inwardly convex circular platform of the bracket, the tubular section (2H1) being identical to or slightly less than the total thickness of the polar plate and the permanent magnet(s) or the repellent-type magnet(s) of the transducer and having smooth and well-defined inner and outer circular surfaces, the tubular tooling (02) having horizontal positioning surfaces (0210 and 0220) which orthogonally intersect the central axis of the tubular tooling;

e) embedding the permanent magnet and the polar plate which are co-axially adhesively fixed into the tubular section having the inner diameter (2D1) and arranging one side of the permanent magnet to face outwardly, and then embedding a second polar plate and coating the coinciding polar surface of one of the permanent magnet or the polar plate with adhesive and meanwhile applying a pressing force thereonto, wherein the polar plate and the permanent magnet are stopped by the horizontal positioning surface (0210) of the tubular tooling (02), and then removing the tubular tooling (02) once the adhesive is cured, so as to attain two polar plates and a permanent magnet sandwiched therebetween which are co-axially adhesively fixed together and which have axial holes;

f) magnetizing the permanent magnet and the polar plates which are co-axially adhesively fixed or magnetizing only the permanent magnet by a proper magnetizing machine, and then alternately using the tubular toolings (01 and 02) so as to attain repellent-type magnets with 3-4 polar plates and 2-3 permanent magnets which are co-axially adhesively fixed together;

g) a bracket (04) which is made of non-magnetic material, with an inwardly convex circular platform at its axial center, the axis of the circular platform being provided with a central axial hole which is matched with the axial holes of the pole plates and the permanent magnet, and an associated quadrangular or hexagonal concave hole, the outer diameter (4D1) of the circular platform being less, in a negative tolerance of 0.01-0.05 mm, than the diameter of the polar plate, and having a fit tolerance of negative 0.01-0.05 mm with respect to the inner diameter (2D1) of the tubular tooling (02), at a corresponding axial height of the annular thin wall of the bracket, there being further provided a smooth and well-defined horizontal positioning surface (0430), the inner circular diameter (4D2) of the annular thin wall having a positive tolerance of 0.1-2 mm with respect to the outer diameter of the annular magnetic yoke, applying the adhesive onto the inwardly convex circular platform (0400) and then placing on the adhesive the polar plates and the permanent magnet(s) or the repellent-type magnets which have already been co-axially adhesively fixed and magnetized, and embedding them into the inner wall of the tubular tooling (02), the inner wall of the tubular tooling (02) being smoothly fit and secured with the vertical outer circular surface (0410) of the inwardly convex circular platform, and meanwhile inserting a non-magnetic material fastener into the central axial holes of the polar plates, the permanent magnets, and the bracket, the horizontal positioning surface (0210) of the tubular tooling (02) closely abutting against the outer polar surface of the polar plate and applying a pressing force, and once the adhesive is cured, the polar plates and the permanent magnet(s) or the repellent-type magnets are adhesively secured to the axial center of the circular platform surface (0400) of the bracket;

h) pre-coating the adhesive onto the horizontal positioning surface (0430) or the vertical positioning surface (0320) of the bracket, and then nesting the annular magnet yoke of the transducer from outer end (2D3) of the tubular tooling (02) and inwardly sliding the annular magnet yoke along the smooth outer circular surface of the tubular section, when the annular magnet yoke reaches the polarized area of the permanent magnet, manually controlling the sliding speed of the annular magnetic yoke to finally limit it by the horizontal positioning surface (0430) of the bracket, and then removing the tubular tooling (02) once the adhesive is cured, so as to prepare two or more groups of symmetrical magnetic paths and two or more co-axial annular magnetic gaps of the same diameter;

i) embedding the upper end of the annular magnetic yoke into the circular axial hole in the bottom of the frame, and adhesively or jointly fixes the annular magnetic yoke with the inner circular hole of the flange in the bottom of the frame, inserting the coil bobbin and two or more coils into the annular magnetic gaps, and then adhering in turns within the frame, one or two elastic damping plates, the coil bobbin, the vibrating membrane or the planar sound generating plate, so as to prepare an inner magnetic transducer with multiple magnetic gaps and multiple coils which has resistance load characteristics or approximately resistance load characteristics and has high sensitivity, high analytic capability and high fidelity.

* * * * *